US009235945B2

(12) United States Patent
Martin

(10) Patent No.: US 9,235,945 B2
(45) Date of Patent: Jan. 12, 2016

(54) COIN INPUT APPARATUSES AND ASSOCIATED METHODS AND SYSTEMS

(71) Applicant: Outerwall Inc., Bellevue, WA (US)

(72) Inventor: Douglas A. Martin, Woodinville, WA (US)

(73) Assignee: Outerwall Inc., Bellevue, WA (US)

( * ) Notice: Subject to any disclaimer, the term of this patent is extended or adjusted under 35 U.S.C. 154(b) by 0 days.

(21) Appl. No.: 14/177,213

(22) Filed: Feb. 10, 2014

(65) Prior Publication Data

US 2015/0228140 A1 Aug. 13, 2015

(51) Int. Cl.

| | |
|---|---|
| ***G07D 3/16*** | (2006.01) |
| ***G07D 3/12*** | (2006.01) |
| ***G07D 9/00*** | (2006.01) |
| *G07D 11/00* | (2006.01) |
| *G07D 3/00* | (2006.01) |

(52) U.S. Cl.

CPC ..... *G07D 3/16* (2013.01); *G07D 3/128* (2013.01); *G07D 9/008* (2013.01); *G07D 3/00* (2013.01); *G07D 11/0018* (2013.01)

(58) Field of Classification Search

CPC ..... G07D 3/00; G07D 11/0018
USPC ..... 453/3, 57, 6, 49; 194/200
See application file for complete search history.

(56) References Cited

U.S. PATENT DOCUMENTS

| | | | |
|---|---|---|---|
| 269,461 | A | 12/1882 | Rakestraw |
| 383,166 | A | 5/1888 | Bailey |
| 446,303 | A | 2/1891 | Thompson |
| 545,185 | A | 8/1895 | Yost |
| 1,010,993 | A | 12/1911 | White |
| 1,234,707 | A | 7/1917 | Whistler |
| 1,345,858 | A | 7/1920 | Jenkins |
| 1,473,745 | A | 11/1923 | Stedman |
| 1,512,447 | A | 10/1924 | Birdsall |
| 1,585,242 | A | 5/1926 | Hageman |
| 1,668,626 | A | 5/1928 | Brandt |
| 1,711,049 | A | 4/1929 | Fonda et al. |
| 1,813,296 | A | 7/1931 | Kidwell |
| 1,847,940 | A | 3/1932 | Giles |

(Continued)

FOREIGN PATENT DOCUMENTS

| | | |
|---|---|---|
| AU | 695403 B2 | 8/1998 |
| AU | 714452 B2 | 1/2000 |

(Continued)

OTHER PUBLICATIONS

Accessories Brochure, Jun. 16, 2005, 3 pages.

(Continued)

*Primary Examiner* — Mark Beauchaine
(74) *Attorney, Agent, or Firm* — Perkins Coie LLP

(57) ABSTRACT

Automatic coin input apparatuses for use with consumer coin counting machines and/or other coin processing machines are disclosed herein. In one embodiment, a coin bowl structure includes a rotatable disk configured to support a plurality of randomly oriented coins deposited thereon. In operation, rotation of the disk in a first direction can automatically drive a first portion of the coins deposited thereon out of the bowl structure through a first coin passage, and rotation of the disk in a second direction opposite to the first direction can automatically drive a second portion of the coins deposited thereon out of the bowl structure through a second coin passage different than the first coin passage.

21 Claims, 15 Drawing Sheets

(56) References Cited

U.S. PATENT DOCUMENTS 1,934,839 A 11/1933 Otto et al.
1,945,948 A 2/1934 Morin
2,014,505 A 9/1935 Patche
2,119,676 A 6/1938 Heller
2,163,351 A 6/1939 Josey
2,317,351 A 4/1943 Andalikiewicz et al.
2,336,606 A 12/1943 Clarence
2,398,955 A 4/1946 O'toole
2,461,314 A 2/1949 Davis et al.
2,519,357 A 8/1950 Dougherty
2,569,360 A 9/1951 Weingart
2,644,470 A 7/1953 Labbe
2,646,805 A 7/1953 Anderson
2,865,561 A 12/1958 Rosapepe
2,869,723 A 1/1959 Autio
2,881,774 A 4/1959 Labbe
2,960,377 A 1/1960 Simjian
2,964,181 A 12/1960 Demarest et al.
3,007,576 A 11/1961 Hannaford
3,009,555 A 11/1961 Seckula, Sr.
3,048,251 A 8/1962 Bower
3,056,132 A 9/1962 Simjian
3,065,467 A 11/1962 Prevost
3,121,435 A 2/1964 White
3,132,654 A 5/1964 Adams
3,143,118 A 8/1964 Haines
3,147,839 A 9/1964 White, Jr.
3,173,742 A 3/1965 Simjian
3,196,257 A 7/1965 Buchholtz et al.
3,196,887 A 7/1965 White, Jr.
3,286,805 A 11/1966 New
3,292,818 A 12/1966 Jaworski
3,351,075 A 11/1967 Weisskopf
3,361,141 A 1/1968 Weisskopf
3,381,694 A 5/1968 Lempke
3,396,737 A 8/1968 Picollo
3,415,348 A 12/1968 Wahlberg
3,599,771 A 8/1971 Hinterstocker et al.
3,603,327 A 9/1971 Buchholz et al.
3,680,566 A 8/1972 Tanaka et al.
3,695,448 A 10/1972 Johansson et al.
3,763,871 A 10/1973 Jobst et al.
3,788,440 A 1/1974 Propice et al.
3,791,574 A 2/1974 Picquot et al.
3,804,249 A 4/1974 Gibbons et al.
3,815,717 A 6/1974 Arseneau
3,941,226 A 3/1976 Drakes
3,960,293 A 6/1976 Sweet, II et al.
3,969,584 A 7/1976 Miller et al.
3,982,620 A 9/1976 Kortenhaus
3,984,660 A 10/1976 Oka et al.
3,998,237 A 12/1976 Kressin et al.
4,014,424 A 3/1977 Hall
4,036,242 A 7/1977 Breitenstein et al.
4,058,954 A 11/1977 Asami et al.
4,059,122 A 11/1977 Kinoshita
4,083,776 A 4/1978 Shimoiizaka et al.
4,092,990 A 6/1978 Bayne
4,099,722 A 7/1978 Rodesch et al.
4,100,925 A 7/1978 Fukunaga et al.
4,106,610 A 8/1978 Heiman
4,109,774 A 8/1978 Hayashi
4,124,109 A 11/1978 Bissell et al.
4,141,372 A 2/1979 Gdanski et al.
4,157,139 A 6/1979 Bjork
4,167,949 A 9/1979 Hashimoto et al.
4,172,462 A 10/1979 Uchida et al.
4,184,366 A 1/1980 Butler
4,216,461 A 8/1980 Werth et al.
4,225,056 A 9/1980 Flubacker
4,228,811 A 10/1980 Tanaka et al.
4,230,213 A 10/1980 Spring
4,236,999 A 12/1980 Burgess et al.
4,238,324 A 12/1980 Musselmann et al.
4,240,589 A 12/1980 Martin et al.
4,249,552 A 2/1981 Margolin et al.
4,266,121 A 5/1981 Hirose et al.
4,266,651 A 5/1981 Strom
4,275,751 A 6/1981 Bergman
4,278,543 A 7/1981 Maniquis et al.
4,301,909 A 11/1981 Snavely
4,306,644 A 12/1981 Rockola et al.
4,321,672 A 3/1982 Braun et al.
4,326,620 A 4/1982 Felix et al.
4,346,798 A 8/1982 Agey, III
4,356,829 A 11/1982 Furuya et al.
4,360,034 A 11/1982 Davila et al.
4,369,442 A 1/1983 Werth et al.
4,369,800 A 1/1983 Watanabe et al.
4,374,557 A 2/1983 Sugimoto et al.
4,376,442 A 3/1983 Gomez et al.
4,380,316 A 4/1983 Glinka et al.
4,383,540 A 5/1983 De Meyer et al.
4,398,550 A 8/1983 Shireman
4,412,292 A 10/1983 Sedam et al.
4,412,607 A 11/1983 Collins et al.
4,414,467 A 11/1983 Gould et al.
4,416,334 A 11/1983 Bouillon
4,434,359 A 2/1984 Watanabe et al.
4,436,103 A 3/1984 Dick
4,442,850 A 4/1984 Austin et al.
4,447,714 A 5/1984 Lundblad et al.
4,471,864 A 9/1984 Marshall
4,503,963 A 3/1985 Steiner
4,504,357 A 3/1985 Holbein et al.
4,506,685 A 3/1985 Childers et al.
4,509,122 A 4/1985 Agnew et al.
4,509,633 A 4/1985 Chow
4,512,453 A 4/1985 Schuller et al.
4,533,054 A 8/1985 Sommer, Jr. et al.
4,535,794 A 8/1985 Bellis et al.
4,535,915 A 8/1985 West
4,542,817 A 9/1985 Paulson
4,543,969 A 10/1985 Rasmussen
4,554,446 A 11/1985 Murphy et al.
4,555,618 A 11/1985 Riskin
4,556,140 A 12/1985 Okada et al.
4,558,711 A 12/1985 Ikuta Yoshiaki et al.
4,577,744 A 3/1986 Doucet et al.
4,587,984 A 5/1986 Levasseur et al.
4,588,712 A 5/1986 Toscano
4,597,487 A 7/1986 Crosby et al.
4,598,378 A 7/1986 Giacomo
4,611,205 A 9/1986 Eglise et al.
4,616,323 A 10/1986 Hayashi
4,616,776 A 10/1986 Blumenthal et al.
4,620,559 A 11/1986 Childers et al.
4,622,456 A 11/1986 Naruto et al.
4,641,239 A 2/1987 Takesako
4,672,377 A 6/1987 Murphy et al.
4,677,565 A 6/1987 Ogaki et al.
4,694,845 A 9/1987 Zay
4,706,577 A 11/1987 Jones et al.
4,706,795 A 11/1987 Mikami et al.
4,716,799 A 1/1988 Hartmann
4,723,212 A 2/1988 Mindrum et al.
4,733,765 A 3/1988 Watanabe et al.
4,753,625 A 6/1988 Okada et al.
4,754,862 A 7/1988 Rawicz-Szczerbo et al.
4,767,917 A 8/1988 Ushikubo
4,775,353 A 10/1988 Childers et al.
4,775,354 A 10/1988 Rasmussen et al.
4,809,837 A 3/1989 Hayashi et al.
4,814,589 A 3/1989 Storch et al.
4,827,423 A 5/1989 Beasley et al.
4,831,374 A 5/1989 Masel
4,833,308 A 5/1989 Humble
4,866,661 A 9/1989 de Prins
4,882,675 A 11/1989 Nichtberger et al.
4,882,724 A 11/1989 Vela et al.
4,883,158 A 11/1989 Kobayashi et al.
4,884,672 A 12/1989 Parker
4,895,238 A 1/1990 Speas
4,896,791 A 1/1990 Smith

(56) References Cited

U.S. PATENT DOCUMENTS 4,898,564 A 2/1990 Gunn et al.
4,910,672 A 3/1990 Off et al.
4,915,205 A 4/1990 Reid et al.
4,921,463 A 5/1990 Primdahl et al.
4,936,436 A 6/1990 Keltner
4,953,086 A 8/1990 Fukatsu et al.
4,959,624 A 9/1990 Higgins, Jr. et al.
4,960,196 A 10/1990 Kanehara et al.
4,963,118 A 10/1990 Gunn et al.
4,964,495 A 10/1990 Rasmussen
4,969,549 A 11/1990 Eglise et al.
4,977,502 A 12/1990 Baker et al.
4,978,322 A 12/1990 Paulsen
4,995,848 A 2/1991 Goh et al.
4,997,406 A 3/1991 Horiguchi et al.
5,010,238 A 4/1991 Kadono et al.
5,015,214 A * 5/1991 Suzuki ..... 453/56
5,021,967 A 6/1991 Smith
5,022,889 A 6/1991 Ristvedt et al.
5,025,139 A 6/1991 Halliburton, Jr.
5,027,937 A 7/1991 Parish et al.
5,039,848 A 8/1991 Stoken
5,040,657 A 8/1991 Gunn et al.
5,055,657 A 10/1991 Miller et al.
5,056,644 A 10/1991 Parker
5,073,767 A 12/1991 Holmes et al.
5,083,765 A 1/1992 Kringel
5,083,814 A 1/1992 Guinta et al.
5,088,587 A 2/1992 Goodrich et al.
5,091,713 A 2/1992 Horne et al.
5,098,339 A 3/1992 Dabrowski
5,098,340 A 3/1992 Abe
5,100,367 A 3/1992 Abe et al.
5,111,927 A 5/1992 Schulze, Jr.
5,113,974 A 5/1992 Vayda
5,114,381 A 5/1992 Ueda et al.
5,122,094 A 6/1992 Abe et al.
5,131,885 A 7/1992 Nakao et al.
5,135,433 A 8/1992 Watanabe et al.
5,151,684 A 9/1992 Johnsen
5,163,868 A 11/1992 Adams et al.
5,166,886 A 11/1992 Molnar et al.
5,167,571 A 12/1992 Waller
5,168,961 A 12/1992 Schneider
5,173,851 A 12/1992 Off et al.
5,174,608 A 12/1992 Benardelli et al.
5,183,142 A 2/1993 Latchinian et al.
5,195,626 A 3/1993 Le Hong et al.
5,201,396 A 4/1993 Chalabian et al.
5,219,059 A 6/1993 Furuya et al.
5,222,584 A 6/1993 Zouzoulas
5,226,519 A 7/1993 DeWoolfson
5,227,874 A 7/1993 Von Kohorn
5,227,966 A 7/1993 Ichiba
5,236,339 A 8/1993 Nishiumi et al.
5,251,738 A 10/1993 Dabrowski
5,252,811 A 10/1993 Henochowicz et al.
5,282,769 A 2/1994 Suzukawa
5,293,981 A 3/1994 Abe et al.
5,299,673 A 4/1994 Wu
5,302,811 A 4/1994 Fukatsu et al.
5,316,120 A 5/1994 Ibarrola
5,316,517 A 5/1994 Chiba et al.
5,317,135 A 5/1994 Finocchio
5,321,242 A 6/1994 Heath, Jr.
5,326,312 A 7/1994 Patroni
5,330,041 A 7/1994 Dobbins et al.
5,337,253 A 8/1994 Berkovsky et al.
5,345,071 A 9/1994 Dumont
5,347,115 A 9/1994 Sherman et al.
5,350,906 A 9/1994 Brody et al.
5,355,988 A 10/1994 Shirasawa
5,356,333 A 10/1994 Bointon et al.
5,360,093 A 11/1994 Baer
5,361,871 A 11/1994 Gupta et al.
5,365,046 A 11/1994 Haymann
5,374,814 A 12/1994 Kako et al.
5,386,902 A 2/1995 Bointon et al.
5,388,680 A 2/1995 Hird et al.
5,408,417 A 4/1995 Wilder
5,409,092 A 4/1995 Itako et al.
5,421,147 A 6/1995 Holden et al.
5,429,222 A 7/1995 Delay et al.
5,429,551 A 7/1995 Uecker et al.
5,435,777 A 7/1995 Takatani et al.
5,441,139 A 8/1995 Abe et al.
5,448,226 A 9/1995 Failing, Jr. et al.
5,449,058 A 9/1995 Kotler et al.
5,457,305 A 10/1995 Akel et al.
5,461,561 A 10/1995 Ackerman et al.
5,469,951 A 11/1995 Takemoto et al.
5,477,952 A 12/1995 Castellano et al.
5,496,211 A 3/1996 Zimmermann
5,499,707 A 3/1996 Steury
5,506,393 A 4/1996 Ziarno
5,513,738 A 5/1996 Hird et al.
5,531,640 A 7/1996 Inoue
5,546,316 A 8/1996 Buckley et al.
5,554,070 A 9/1996 Takatoshi et al.
5,555,497 A 9/1996 Helbling
5,560,467 A 10/1996 Takemoto
5,564,546 A 10/1996 Molbak et al.
5,577,959 A 11/1996 Takemoto et al.
5,583,487 A 12/1996 Ackerman et al.
5,595,264 A 1/1997 Trotta, Jr.
5,620,079 A 4/1997 Molbak
5,624,017 A 4/1997 Plesko
5,637,845 A 6/1997 Kolls
5,641,050 A 6/1997 Smith et al.
5,650,604 A 7/1997 Marcous et al.
5,652,421 A 7/1997 Veeneman et al.
5,665,952 A 9/1997 Ziarno
5,679,070 A 10/1997 Ishida et al.
5,699,328 A 12/1997 Ishizaki et al.
5,704,049 A 12/1997 Briechle
5,711,704 A 1/1998 Hughes et al.
5,732,398 A 3/1998 Tagawa
5,743,429 A 4/1998 Morofsky
5,799,767 A 9/1998 Molbak
5,839,956 A 11/1998 Takemoto et al.
5,842,916 A 12/1998 Gerrity et al.
5,868,236 A 2/1999 Rademacher
5,875,110 A 2/1999 Jacobs
5,880,444 A 3/1999 Shibata et al.
5,898,383 A 4/1999 Forsythe
5,909,792 A 6/1999 Gerlier et al.
5,909,793 A 6/1999 Beach et al.
5,909,794 A 6/1999 Molbak et al.
5,910,044 A 6/1999 Luciano, Jr. et al.
5,929,366 A 7/1999 Kennedy
5,941,363 A 8/1999 Partyka et al.
5,957,262 A 9/1999 Molbak et al.
5,974,146 A 10/1999 Randle et al.
5,975,276 A 11/1999 Yeh
5,991,413 A 11/1999 Arditti et al.
6,016,481 A 1/2000 Failing, Jr. et al.
6,017,063 A 1/2000 Nilssen
6,021,883 A 2/2000 Casanova et al.
6,030,284 A 2/2000 Frank
6,042,471 A 3/2000 Tanaka
6,047,807 A 4/2000 Molbak
6,059,650 A 5/2000 Stoltz et al.
6,082,519 A 7/2000 Martin et al.
6,095,313 A 8/2000 Molbak et al.
6,095,916 A 8/2000 Tamaki
6,105,009 A 8/2000 Cuervo
6,110,044 A 8/2000 Stern
6,119,099 A 9/2000 Walker et al.
6,138,106 A 10/2000 Walker et al.
6,144,946 A 11/2000 Iwamura et al.
6,168,001 B1 1/2001 Davis
6,171,182 B1 * 1/2001 Geib et al. ..... 453/10
6,185,545 B1 2/2001 Resnick et al.
6,227,343 B1 5/2001 Neathway et al.

(56) References Cited

U.S. PATENT DOCUMENTS

| | | | | |
|---|---|---|---|---|
| 6,230,928 | B1 | 5/2001 | Hanna et al. | |
| 6,233,564 | B1 | 5/2001 | Schulze, Jr. | |
| 6,253,809 | B1 | 7/2001 | Paradies | |
| 6,264,104 | B1 | 7/2001 | Jenkins et al. | |
| 6,289,324 | B1 | 9/2001 | Kawan | |
| 6,292,211 | B1 | 9/2001 | Pena | |
| 6,318,536 | B1 | 11/2001 | Korman et al. | |
| 6,398,637 | B1 | 6/2002 | Tsuchida | |
| 6,401,010 | B1 | 6/2002 | Takahashi | |
| 6,405,182 | B1 | 6/2002 | Cuervo | |
| 6,415,262 | B1 | 7/2002 | Walker et al. | |
| 6,484,863 | B1 | 11/2002 | Molbak | |
| 6,494,776 | B1 | 12/2002 | Molbak | |
| 6,505,774 | B1 | 1/2003 | Fulcher et al. | |
| 6,536,037 | B1 | 3/2003 | Guheen et al. | |
| 6,554,184 | B1 | 4/2003 | Amos | |
| 6,602,125 | B2 * | 8/2003 | Martin | 453/12 |
| 6,609,604 | B1 | 8/2003 | Jones et al. | |
| 6,704,039 | B2 | 3/2004 | Pena | |
| 6,705,448 | B1 | 3/2004 | Steel et al. | |
| 6,725,630 | B2 | 4/2004 | Rea et al. | |
| 6,736,251 | B2 | 5/2004 | Molbak | |
| 6,758,316 | B2 | 7/2004 | Molbak | |
| 6,817,052 | B2 | 11/2004 | Grube | |
| 6,829,596 | B1 | 12/2004 | Frazee | |
| 7,113,929 | B1 | 9/2006 | Beach et al. | |
| 7,303,119 | B2 | 12/2007 | Molbak | |
| 7,422,518 | B2 | 9/2008 | Kotani | |
| 7,464,802 | B2 | 12/2008 | Gerrity et al. | |
| 7,527,193 | B2 | 5/2009 | Molbak | |
| 7,658,668 | B2 | 2/2010 | Hill | |
| 7,735,622 | B2 * | 6/2010 | String | 194/347 |
| 7,865,432 | B2 | 1/2011 | Doran et al. | |
| 7,874,478 | B2 | 1/2011 | Molbak | |
| 7,971,699 | B2 | 7/2011 | Molbak et al. | |
| 8,109,379 | B2 | 2/2012 | Sjostrom | |
| 8,522,950 | B2 | 9/2013 | Martin | |
| 8,550,227 | B1 | 10/2013 | Martin | |
| 2007/0099553 | A1 * | 5/2007 | Blaha et al. | 453/61 |
| 2007/0212997 | A1 * | 9/2007 | Kurosawa | 453/49 |

FOREIGN PATENT DOCUMENTS

| | | | | |
|---|---|---|---|---|
| CA | 1053598 | | 5/1979 | |
| CA | 2060630 | | 8/1992 | |
| CA | 2067987 | | 11/1992 | |
| CA | 2143943 | A1 | 3/1994 | |
| CA | 2189330 | A1 | 11/1995 | |
| CA | 2235925 | A1 | 11/1995 | |
| CH | 680171 | | 6/1992 | |
| DE | 660354 | C | 5/1938 | |
| DE | 2528735 | A1 | 4/1976 | |
| DE | 3021327 | A1 | 12/1981 | |
| DE | 3147603 | | 6/1983 | |
| EP | 0164733 | A2 | 12/1985 | |
| EP | 0 351 217 | | 1/1990 | |
| EP | 0420163 | A1 | 4/1991 | |
| EP | 0477722 | | 4/1992 | |
| EP | 0710932 | A1 | 5/1996 | |
| EP | 0766859 | A1 | 4/1997 | |
| EP | 0857579 | A2 | 8/1998 | |
| EP | 0924662 | A2 | 6/1999 | |
| EP | 0924664 | | 6/1999 | |
| EP | 0924665 | A2 | 6/1999 | |
| EP | 1178448 | | 2/2002 | |
| EP | 1231579 | | 8/2002 | |
| EP | 1939821 | A1 | 7/2008 | |
| EP | 1956563 | A1 | 8/2008 | |
| EP | 2226769 | A1 | 9/2010 | |
| EP | 2754136 | | 7/2014 | |
| FR | 2042254 | A5 | 2/1971 | |
| FR | 2342531 | A1 | 9/1977 | |
| FR | 2845189 | | 4/2004 | |
| GB | 958741 | | 5/1964 | |
| GB | 1255492 | A | 12/1971 | |
| GB | 1564723 | | 4/1980 | |
| GB | 2095452 | | 9/1982 | |
| GB | 2153128 | A | 8/1985 | |
| GB | 2175427 | A | 11/1986 | |
| GB | 2186411 | A | 8/1987 | |
| GB | 2188467 | | 9/1987 | |
| GB | 2198274 | A | 6/1988 | |
| GB | 2 208 738 | A * | 4/1989 | G07D 9/00 |
| GB | 2223340 | A | 4/1990 | |
| GB | 2223872 | A | 4/1990 | |
| GB | 2225918 | A | 6/1990 | |
| GB | 2237912 | A | 5/1991 | |
| GB | 2255666 | A | 11/1992 | |
| GB | 2341711 | A | 3/2000 | |
| GB | 2356966 | A | 6/2001 | |
| GB | 2357885 | A | 7/2001 | |
| GB | 2357886 | A | 7/2001 | |
| JP | 0097469 | | 5/1985 | |
| JP | 1258092 | A | 10/1989 | |
| JP | 1307891 | A | 12/1989 | |
| JP | 2081193 | | 3/1990 | |
| JP | 3-63795 | | 3/1991 | |
| JP | 392994 | | 4/1991 | |
| JP | 3252795 | A | 11/1991 | |
| JP | 0433194 | | 4/1992 | |
| JP | 4-67776 | | 6/1992 | |
| JP | 4315288 | A | 11/1992 | |
| JP | 4344995 | | 12/1992 | |
| JP | 5249892 | A | 9/1993 | |
| JP | 5250296 | A | 9/1993 | |
| JP | 07306976 | | 11/1995 | |
| MX | 9605331 | A | 12/1997 | |
| SE | 44244 | | 9/1918 | |
| SE | 44247 | | 9/1918 | |
| SE | 50250 | | 11/1919 | |
| SE | 8801851 | A | 11/1989 | |
| WO | WO-9307846 | A1 | 4/1993 | |
| WO | WO-9406101 | A1 | 3/1994 | |
| WO | WO-9409440 | A1 | 4/1994 | |
| WO | WO-95/30215 | | 11/1995 | |
| WO | WO-96/30877 | | 10/1996 | |
| WO | WO-9707485 | A1 | 2/1997 | |
| WO | WO-9950785 | | 10/1999 | |
| WO | WO-0010138 | | 2/2000 | |
| WO | WO-2008024043 | A1 | 2/2008 | |

OTHER PUBLICATIONS

Bedienungsanleitung CDS 500/MCC 500, 1991, 9 pages.

Cash, M., "Bank Blends New Technology with Service", Winnipeg Free Press, Sep. 4, 1992, 1 page.

CDS Automated Receipt Giving Cash Deposit System, Case-ICC Limited, Dec. 22, 2006, 3 pages.

Cohen, P., "Coinstar Turns Loose Change into iTunes Songs," Yahoo News, http://news.yahoo.com/s/macworld/20060410/tc_macworld/coinstar20060410_0, Apr. 10, 2006, pp. 1-3.

F. Zimmerman & Co., "Reference Manual Contovit/Sortovit, Perconta Money Counting and Sorting Systems," Aug. 1995, pp. I-III, 1-31, and three pages of specifications.

Fri Kopenskap articles, Mar. 18, 1988, Apr. 27, 1989 and Nov. 25, 1988, 6 pages.

Geldinstitute Literature, Mar. 1990 and Apr.-May 1992, 2 pages.

Hamilton, Martha M., "Turning Cans into Cold Cash", The Washington Post, Jul. 2, 1991, pp. D1, D4, pp. 194-209.

Kundenselbstbedienung, Dec. 22, 2006, 4 pages.

Kunderna fixar vaxeln, Praktiska, Dec. 12, 2006, 2 pages.

Leitch, C., "High-tech bank counts coins," *Innovations,* Report on Business, Sep. 18, 1991, 1 page.

Liemeon, J., "Royal's Burlington drive-in bank provides customers 24-hour tellers," *Business Today, The Toronto Star,* Aug. 21, 1991, 1 page.

NCR, "NCR 7800 Consumer Price Verifier," http://www3.ncr.com/product/retail/product/catalog/7800.shtml, accessed Mar. 18, 1999, 2 pages.

Oxby, M., "Royal Bank opens 'Super Branch,'" The Gazette Montreal, Sep. 14, 1991, 1 page.

(56) References Cited

OTHER PUBLICATIONS

Reis Eurosystems Geldbearbeitungssysteme, "Test-Programme CS 3110 Selectronic Coin Sorting and Counting Machine", Jul. 1992, 5 pages.
Reis Eurosystems, "Operating Instructions CS 3110 Selectronic Coin Sorting and Counting Machine With Central Sensor", Jul. 1992, 10 pages.
SC4000 Coin Discriminating System, Including Perforated, Vibrating Coin Feeding and Cleaning Tray Assembly; On sale in the US by Scan Coin Since at least Dec. 1994 (including photographs, drawings and parts lists), 92 pages.
Scan Coin 4000 Value Sorter, Operator's Instruction Manual, Jun. 1995, 56 pages.
Scan Coin AB, "Scan Coin 4000 Value Sorter" and product photos, on sale in the U.S. prior to Sep. 2001, 11 pages.
Scan Coin AB, 1989, Jagershillgatan 26, S-213, 75 Malmo, Sweden, Technical Referens Manual, CDS Coin Deposit System, 47 pages.
Scan Coin CDS 600 Cash Deposit System, Brochure, Jun. 15, 1994, 2 pages.
Scan Coin CDS 640 Cash Deposit System Brochure, published at least by May 12, 2006, 2 pages.
Scan Coin CDS Brochure, Sep. 1988, 6 pages.
Scan Coin CDS Munzgeldeinzahlungen in Selbstbedienung: Cash Deponier System CDS 500, 1994, 6 pages.
Scan Coin correspondence regarding supermarkets, Sep. 11, 1992, 4 pages.
Scan Coin International Report, Apr. 1987, 49 pages.
Scan Coin Money Processing Systems, Oct. 1, 1988, 9 pages.
Scan Coin Newsletter, May 1991, 2 pages.
Scan Coin Sales Invoices for Coin Counters in the United States, 1989-1993, 29 pages.
Scan Coin SC4000 Operating Instructions, dated Aug. 10, 1994, 6 pages.
Scan Coin Technical Manual CDS MK 1 Coin Deposit System; 1991, 98 pages.
Scan Coin Technical Manual SC 102 Value Counter, Available prior to Jul. 2011, 28 pages.
Scan Coin Technical Manual SC4000, dated Jul. 29, 1994, 12 pages.
Scan Coin Technical Reference Manual CDS Coin Deposit System (odd pages only) 1989, 47 pages.
Scan Coin User's Manual, CDS 600, 1991, 14 pages.
Scan Coin User's Manual, CDS 640, 1988, 7 pages.
Scan Coin World Newsletters, Scan Coin AB, Jagerhillgatan 26, S-213 75 Malmo, Sweden, 1988-1990, 6 pages.
Sheehan, Michael, "Marriage of Convenience," available at <http://www.kioskbusiness.com/NovDec01/articles/article4.html>, accessed May 19, 2003, 3 pages.
Slide Changing Apparatus With Slide Jam Protection, Research Disclosure 30509, Sep. 1989, 3 pages.
Super Branch Literature, Feb. 1992, 2 pages.
Svenska Penninglotteriet Documents, 1988, 70 pages.
Technical Manual, Cash Deposit System, Model CDS 600 & CDS 640, 1991, 46 pages.
Technical Specifications GBS9401 SB, Prior to Nov. 10, 2010, 24 pages.
Wennergren-Williams, "Who Wants a Computer Consultant Who Thinks the Same Way as Everyone Else?" Priab Prisma, vol. 1, 1989, 7 pages.

* cited by examiner

COIN INPUT APPARATUSES AND ASSOCIATED METHODS AND SYSTEMS

TECHNICAL FIELD

The following disclosure relates generally to coin processing machines and, more particularly, to coin input apparatuses and methods for use with coin counting and/or sorting machines, such as consumer-operated coin counting machines and the like.

BACKGROUND

Various types of coin counting machines are known. Some coin counting machines (e.g., vending machines, gaming devices such as slot machines, and the like) are configured to receive one coin at a time through a slot. These machines are relatively simple and typically designed for relatively low throughput and little, if any, coin cleaning. Such machines, however, are usually ill-suited for counting large quantities of consumer coins received all at once (such as a large quantity of coins poured into a machine from, e.g., a coin jar).

Machines for counting and/or sorting relatively large quantities of consumer coins include those disclosed in, for example, U.S. Pat. Nos. 5,620,079, 7,028,827, 7,520,374, and 7,865,432, each of which is incorporated herein by reference in its entirety. Some of these machines count consumer coins and dispense redeemable cash vouchers, while others may offer other types of products and services either exclusively or in addition to vouchers. Such products and services can include, for example, dispensing and/or topping-up prepaid cards (e.g., gift cards, phone cards, etc.), "e-certificates," and the like, and transfers to online accounts (e.g., Paypal™), mobile wallets, etc. Vouchers can be redeemed for cash and/or merchandise at a point of sale (POS) in a retail establishment, while e-certificates can enable the holder to purchase items online by inputting a code from the e-certificate when making the purchase. Prepaid gift cards can be used to make POS purchases by, for example, swiping the card through a conventional card reader, and prepaid phone cards can be used for making cell phone calls. The term "mobile wallet" can refer generally to an electronic commerce account implemented by a mobile phone or other mobile wireless device. In some embodiments, mobile wallets store "virtual gift cards," virtual loyalty cards, etc.; transfer value; and/or conduct transactions for, e.g., purchasing goods and/or services from suitably enabled merchants. The term "virtual gift card" can refer to an application program operating on the mobile device that performs like a prepaid card, such as a gift card. Virtual gift cards can enable the user to wirelessly purchase items and/or services, pay bills, and/or conduct other transactions with retailers and other merchants via, e.g., a wirelessly enabled point of sale (POS) terminal, the Internet, and/or other computer networks.

Some coin counting and/or sorting machines include a hinged coin input tray that is manually lifted by the user to introduce their coins into the machine for processing. Such an input tray is disclosed in, for example, U.S. Pat. No. 5,620,079. When at rest, the input tray is angled downward and away from a raised hinge line that forms a slight peak. This prevents coins in the tray from flowing into the machine until the user begins rotating the tray upwardly about the peak. As the user continues lifting the input tray, the coins begin to slide out of the tray, over the peak and into the machine for counting and/or sorting. In some instances, the user may be required to use their hands to manually control the flow of coins out of the input tray. For example, if the user lifts the tray too fast, the user may need to place their hands near the peak to prevent coins from leaving the input tray too quickly and jamming the machine. On the other hand, if the user lifts the tray too slowly, the user may need to move some coins out of the tray and over the peak by hand. In either case, user involvement may be necessary to facilitate the coin input process. U.S. Pat. No. 6,602,125, which is incorporated herein by reference in its entirety, disclosed an automatic coin input tray for a self-service coin-counting machine. The input tray employed a spring-loaded rotating disk that would drop if the user poured in more coins than the tray could initially process. This dropping feature can make it difficult to adequately seal gaps between the rotating disk and the surrounding coin bowl.

Speed and accuracy are important considerations in self-service coin counting machines. Consumers are less inclined to use a coin counting machine if they have to wait an appreciable amount of time to have their coins counted. Coin counting machines should also be accurate and relatively easy to operate to encourage use. Accordingly, it would be advantageous to provide coin counting machines with coin input systems that are relatively easy to use, and facilitate accurate and relatively fast counting of large quantities of coins.

DETAILED DESCRIPTION

Figure 1A:
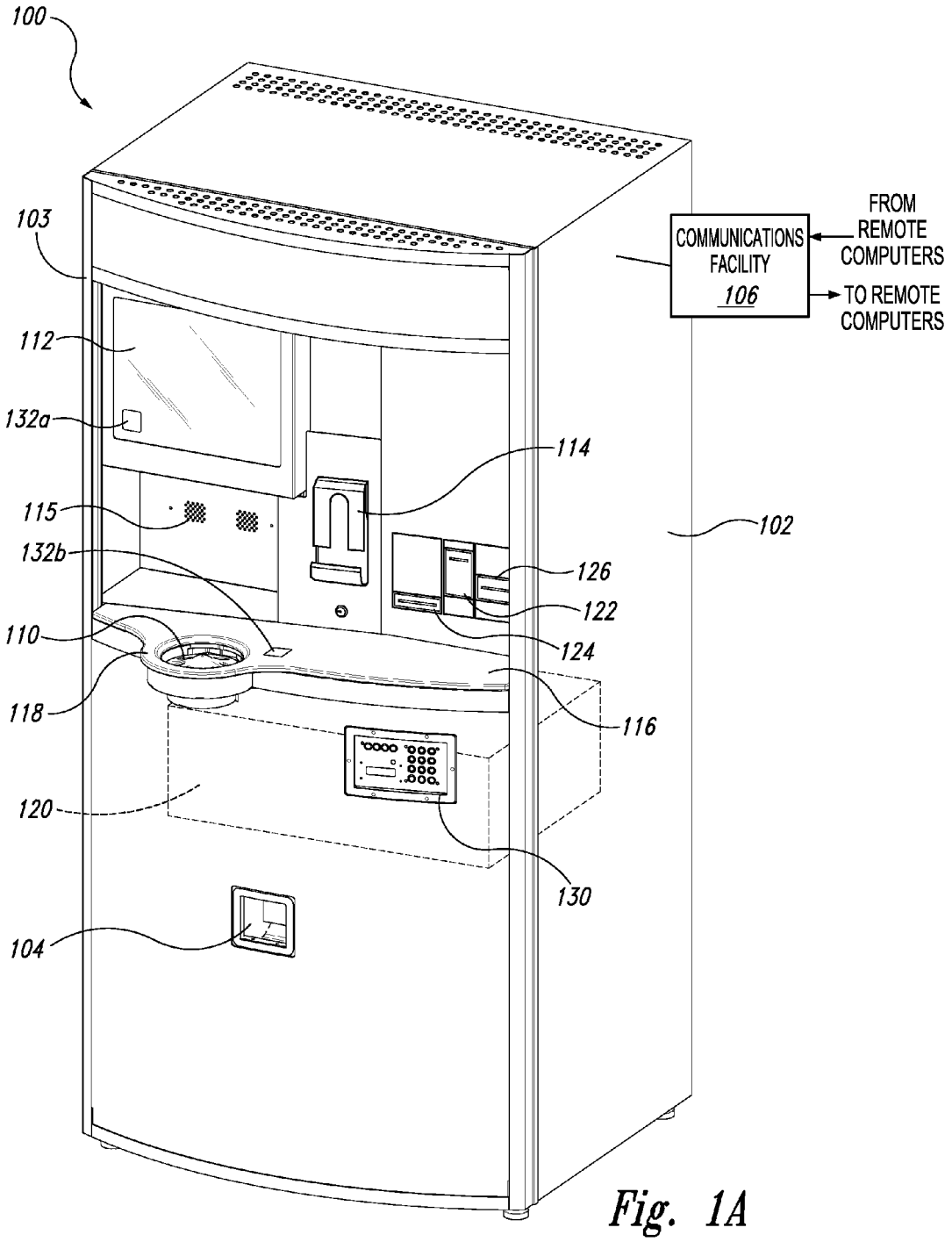
FIGS. 1A-1C are a series of front isometric views of a coin counting kiosk having a coin input apparatus configured in accordance with an embodiment of the present technology.

The following disclosure describes various embodiments of apparatuses, systems and methods for receiving a plurality of coins and transferring the coins into a kiosk or machine for, e.g., counting, sorting and/or other processing of the coins. In some embodiments, for example, a coin input tray configured in accordance with the present technology can include a rotating disk disposed in a bowl structure for transferring coins placed thereon into a consumer-operated coin-counting kiosk or similar machine for counting therein. In operation, the coin disk can automatically change direction of rotation to quickly and efficiently transfer the coins into the consumer-operated kiosk without requiring the user to manually move the coins into the kiosk for counting and/or other processing. As described in greater detail below, in some embodiments the rotating coin disk can drive the coins out of the coin input tray along two different paths depending on the direction of disk rotation, and this feature can reduce the tendency of coins to jam or otherwise clog the outlet opening of the coin input tray.

The various embodiments of coin input apparatuses described herein can be used with various types of self-service and/or consumer-operated coin counting machines configured to receive large batches of random coins from users in exchange for, e.g., redeemable cash vouchers, prepaid cards (e.g., gift cards), e-certificates, etc., and/or deposits in on-line accounts, mobile wallets, etc. Certain details are set forth in the following description and in FIGS. 1A-6C to provide a thorough understanding of various embodiments of the present technology. In some instances well-known structures, materials, operations, and/or systems often associated with coin counting machines and associated systems and methods are not shown or described in detail herein to avoid unnecessarily obscuring the description of the various embodiments of the technology. Those of ordinary skill in the art will recognize, however, that the present technology can be practiced without one or more of the details set forth herein, or with other structures, methods, components, and so forth.

The accompanying Figures depict embodiments of the present technology and are not intended to be limiting of its scope. The sizes of various depicted elements are not necessarily drawn to scale, and these various elements may be arbitrarily enlarged to improve legibility. Component details may be abstracted in the Figures to exclude details such as position of components and certain precise connections between such components when such details are unnecessary for a complete understanding of how to make and use the invention.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar, elements. To facilitate the discussion of any particular element, the most significant digit or digits of any reference number refers to the Figure in which that element is first introduced. For example, element 110 is first introduced and discussed with reference to FIG. 1A.

FIG. 1A is a partially schematic front isometric view of a consumer-operated kiosk 100 having a coin input apparatus configured in accordance with an embodiment of the present technology. In the illustrated embodiment, the coin input apparatus includes a coin input tray 110 that is accessibly positioned on a "bump-out" 118 of a countertop or deck 116 of the kiosk 100. By way of example, the kiosk 100 can be a consumer-operated coin counting machine that can include, for example, the ability to count consumer coins poured into the coin input tray 110 and dispense redeemable vouchers (e.g., cash vouchers), dispense and/or reload prepaid cards, dispense e-certificates for on-line purchases, transfer funds to remote accounts (e.g., on-line payment accounts, etc.), and/or provide other products and services in exchange for the coins. The kiosk 100 and associated systems, and various embodiments thereof, can be at least generally similar in structure and function to one or more of the kiosks and associated systems and methods disclosed in: U.S. Pat. Nos. 8,482,413, 7,865,432, 7,815,071, 7,653,599, 7,520,374, 7,014,108, 6,494,776, 6,168,001, 6,047,808, 5,988,348, 5,842,916, 5,799,767 and 5,620,079; and U.S. patent application Ser. Nos. 13/802,070, 13/790,674, 13/728,905, 13/367,129, 13/304,254 and 13/286,971, each of which is incorporated herein by reference in its entirety.

In the illustrated embodiment, the kiosk 100 includes a display screen 112 (e.g., a video screen) that can display various user-selection graphics or buttons (via, e.g., a touch screen) that enables the user to make selections and provide operating instructions to the kiosk 100 in response to prompts displayed on the display screen 112. The kiosk 100 can additionally include a speaker 115 for audibly providing prompts, instructions, advertisements, etc. to users. The kiosk 100 can also include a voucher outlet 114 that can dispense, e.g., a redeemable voucher, e-certificate, etc. for all or a portion of the value of the coins deposited in the coin input tray 110. In some embodiments, the kiosk 100 can also include a card outlet 122 from which the user can receive, e.g., a new prepaid card (e.g., a prepaid gift card, phone card, credit card, etc.), an e-certificate, etc. for all or a portion of the coin value, a card reader 124 with which the user can swipe an existing prepaid card and reload or "top-up" the card or an associated account with all or a portion of the coin value, and/or a bill accepter 126 for receiving paper currency from the user in payment for a product or service. In some embodiments, the kiosk 100 can include additional user-interface devices, such as a user-interface panel 130 accessibly positioned below the deck 116 and having various user input devices including, for example, a keypad, a card reader, a bill acceptor, etc. The kiosk 100 can additionally include a communications facility 106 (e.g., a router, modem, etc.; shown schematically) for remotely exchanging information with various user computers, servers, financial institutions, and/or other remote computer systems and providing the various kiosk products and services described herein. The kiosk 100 can operate in a network environment using logical connections to one or more remote computers over various suitable communications links, including the Internet. Such remote computers can include, for example, personal computers, servers, routers, network PCs, network nodes, etc. In network environments, program modules, application programs, and/or data, or portions thereof, can be stored in remote computers and accessed by or sent to the kiosk 100, and/or sent from the kiosk 100 to one or more remote computers. The communications facility 106 and/or the associated network connections discussed above are only some examples of suitable communication links between the kiosk 100 and other remote computers and associated devices. In other embodiments, other types of communication facilities and links, including wireless links, can be used. Such networking environments are well known, and can include links comprising Local Area Networks (LAN), Wide Area Networks (WAN), or the Internet. In such distributed computing environments, program modules may be located in both local and remote memory storage devices.

The kiosk 100 described above is merely representative of one type of consumer-operated or self-service kiosk, commercial enclosure, or other type of coin processing machine that can utilize the coin input apparatuses, systems and methods described herein. Accordingly, in other embodiments, other types of consumer-operated kiosks, machines, etc. can utilize the technology described herein. Such kiosks can include, for example, DVD rental kiosks, food vending machines such as coffee vending machines, card dispensing machines, gift card dispensing and exchange machines, etc. Moreover, in other embodiments other kiosks and machines utilizing the coin input apparatuses, systems and methods described herein can include more, fewer, or different functionalities than those described herein.

In operation, the user wishing to have, for example, a batch of coins of random denomination counted by the kiosk 100 (in return for, e.g., a redeemable voucher, e-certificate, gift card value, transfer to online account, transfer to mobile wallet, etc.) can approach the kiosk 100 and pour the coins into the coin input tray 110. As described in greater detail below, the coin input tray 110 can include a rotating coin disk forming a bottom-portion thereof. In some embodiments, the user can press a start button to begin rotation of the coin disk for transferring the coins into the kiosk 100 for counting. The start button can be, e.g., graphically represented on the display screen 112 by a start button icon 132*a* or similar feature. In other embodiments, the kiosk 100 can include an physical start button 132*b* positioned proximate the coin input 110 which the user can depress to start the coin input process. In still further embodiments, the kiosk 100 can include a coin detection sensor that automatically starts rotation of the coin disk (and/or other coin processing components and systems) in response to detecting, for example, the presence of coins placed on the coin disk. As described in greater detail below, in some embodiments the coin disk can rotate in a first direction for a preset (or user-controlled) period of time (or number of rotations), and then stop (and/or pause) and rotate in the opposite direction for a preset (or user-controlled) period of time. This back and forth process can continue until all the coins have been transferred from the coin input tray 110 to a coin counting and/or sorting apparatus 120 (shown schematically in FIG. 1A) housed within the kiosk 100. The coin counting and/or sorting apparatus 120 can count the coins to determine a value which the user can apply to their selected product and/or service. In the illustrated embodiment, the kiosk 100 can also include a coin return outlet 104 for returning coins to the user that were not counted, including fraudulent coins, damaged coins, and/or if the user wishes to decline the coin counting operation.

In some embodiments, a coin input tray cover (not shown), such as a clear plastic cover, can be hingedly or otherwise attached to the kiosk deck 116 proximate the coin input tray 110. The user can open the cover to pour their coins into the coin input tray 110, and then close the cover before pressing the start button 132*a, b* to begin the coin intake process. In other embodiments, the coin disk can begin rotating automatically in response to a signal generated by the cover being closed. In some embodiments, the use of a cover can reduce the ambient noise from operation of the coin input tray 110.

In the illustrated embodiment, the kiosk 100 includes an external housing, such as an enclosure 102, having a hinged access panel, such as a door 108 that permits access to the interior portion of the enclosure 102. The door 108 is rotatably mounted proximate a corner portion of the enclosure 102 by a vertical hinge 103. The hinge 103 allows the door 108 to rotate between a closed position as shown in FIG. 1A, and an open position as shown in FIGS. 1B and 1C.

Figure 1B:
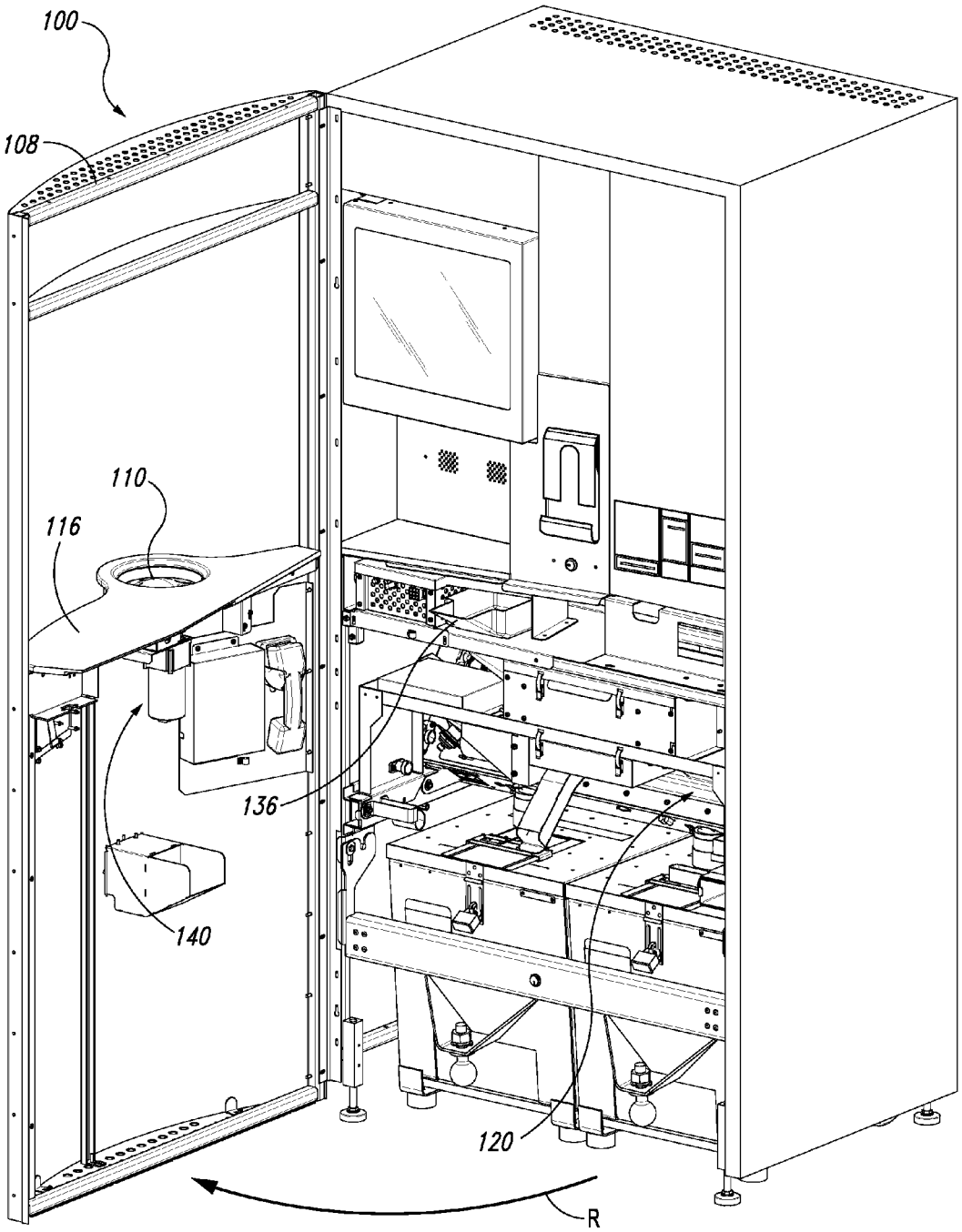

Referring to FIG. 1B, the door 108 can be unlocked and rotated in direction R to an open position for, e.g., servicing of the coin counting and/or sorting apparatus 120. As this view illustrates, in the illustrated embodiment the coin input tray 110 and the deck 116 are fixedly mounted to the door 108. Moreover, in this embodiment the coin input tray 110 is driven in operation by a drive system 140 that is positioned beneath the deck 116 and carried by the door 108. As described in greater detail below, the coin input tray 110 includes a coin outlet opening or passageway that directs coins from the coin input tray 110 into an adjacent funnel 136 for conveyance to the coin counting and/or sorting apparatus 120. In one aspect of the illustrated embodiment, the coin outlet opening of the coin input tray 110 can passively disengage or otherwise move away from the funnel 136 when the door 108 is rotated to the open position. This arrangement enables the coin input tray 110 and the associated drive system 140 to be easily serviced after the door 108 has been opened. As described in greater detail below with reference to FIG. 1C, this arrangement can also facilitate servicing of the coin counting and/or sorting apparatus 120.

In the illustrated embodiment, the coin counting and/or sorting apparatus 120 can be at least generally similar in structure and function to the coin counting and/or sorting apparatuses disclosed in U.S. patent application Ser. No. 13/906,126, filed May 30, 2013 and entitled "COIN COUNTING AND/OR SORTING MACHINES AND ASSOCIATED SYSTEMS AND METHODS," which is incorporated herein in its entirety by reference. In the illustrated embodiment, the apparatus 120 is configured and/or used as a coin counting apparatus, but in other embodiments the apparatus 100 can be suitably configured and/or used as a coin sorter, or as a coin counter and sorter. Accordingly, for ease of reference the apparatus 120 is referred to herein as a coin "processing" apparatus, with the understanding that the apparatus 120 and various features and structures thereof can be used in various embodiments for coin counting, coin sorting, or for coin counting and sorting. In other embodiments, the kiosk 100 and/or other kiosks and machines utilizing the coin input technology and related technologies described herein can include other types of coin counting and/or sorting apparatuses, systems, and/or methods, such as those disclosed in U.S. patent application Ser. No. 13/778,461, filed Feb. 27, 2013, and entitled "COIN COUNTING AND SORTING MACHINES," which is also incorporated herein in its entirety by reference.

Figure 1C:
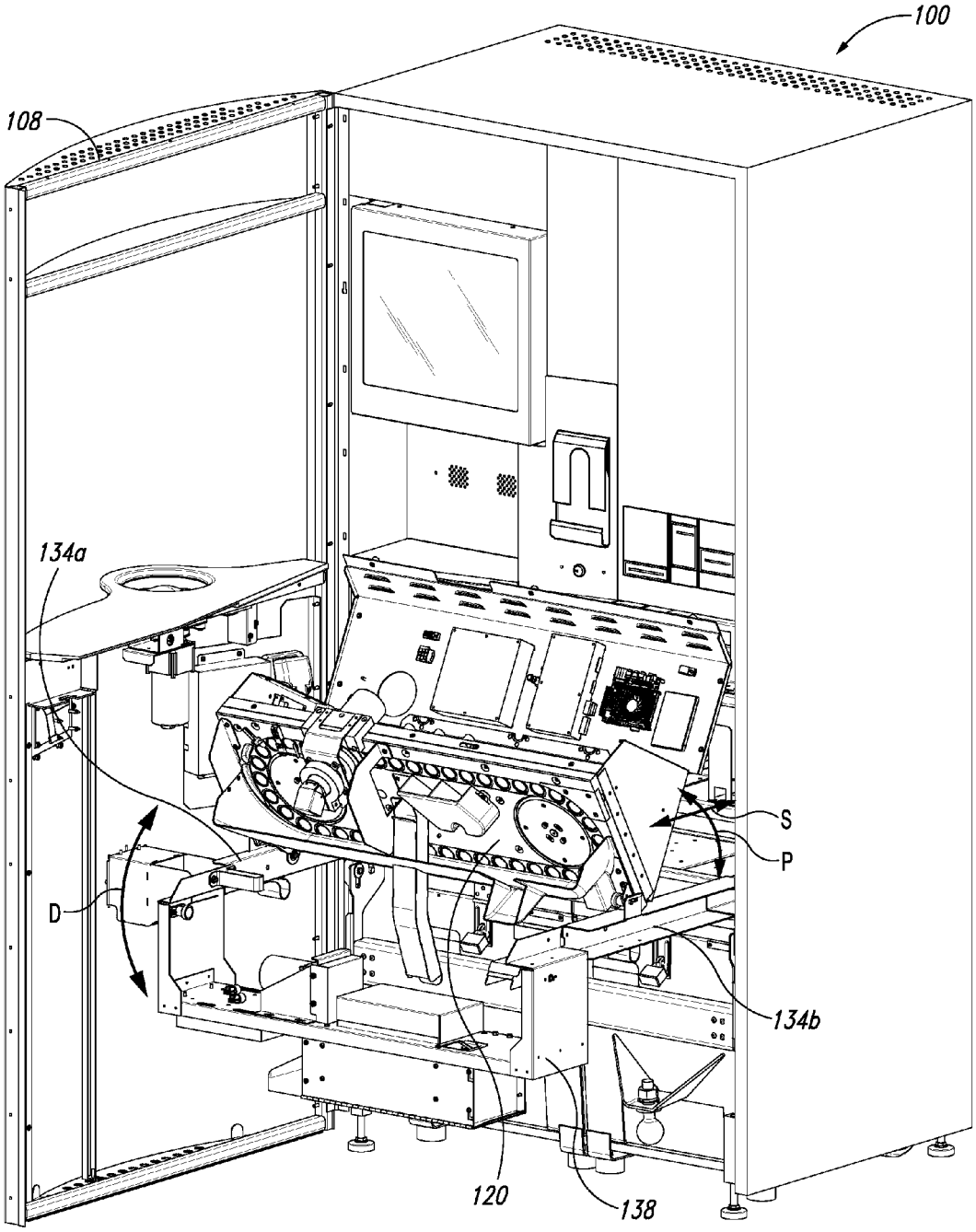

In some embodiments as illustrated in FIG. 1C, the coin processing apparatus 120 can be moved forward from its operating position on extendable rails 134 (identified individually as a first rail 134*a* and a second rail 134*b*). For example, in the illustrated embodiment a service person can pull on the coin processing apparatus 120 to extend the rails 134 outwardly in direction S with the coin processing apparatus 120 supported thereon. Once the coin processing apparatus 120 is positioned generally clear of the surrounding kiosk structure, a structure 138 that supports a coin cleaner (e.g., the coin cleaner 230 described below with reference to FIGS. 2A-2C) can be rotated downwardly in the direction of arrow D, and the coin processing apparatus 120 can be rotated upwardly and forward in the direction of arrow P to afford the service person access to various components and systems associated with the coin processing apparatus 120. Once any necessary servicing has been completed, the coin processing apparatus 120 can be rotated downwardly in the direction of the arrow P, the structure 138 can be rotated upwardly in the direction of the arrow D, and the coin processing apparatus 120 can be pushed back into the kiosk 100 on the rails 134 in direction S. The door 108 can then be rotated to the closed position shown in FIG. 1A and the kiosk 100 put back into service.

Figure 2A:
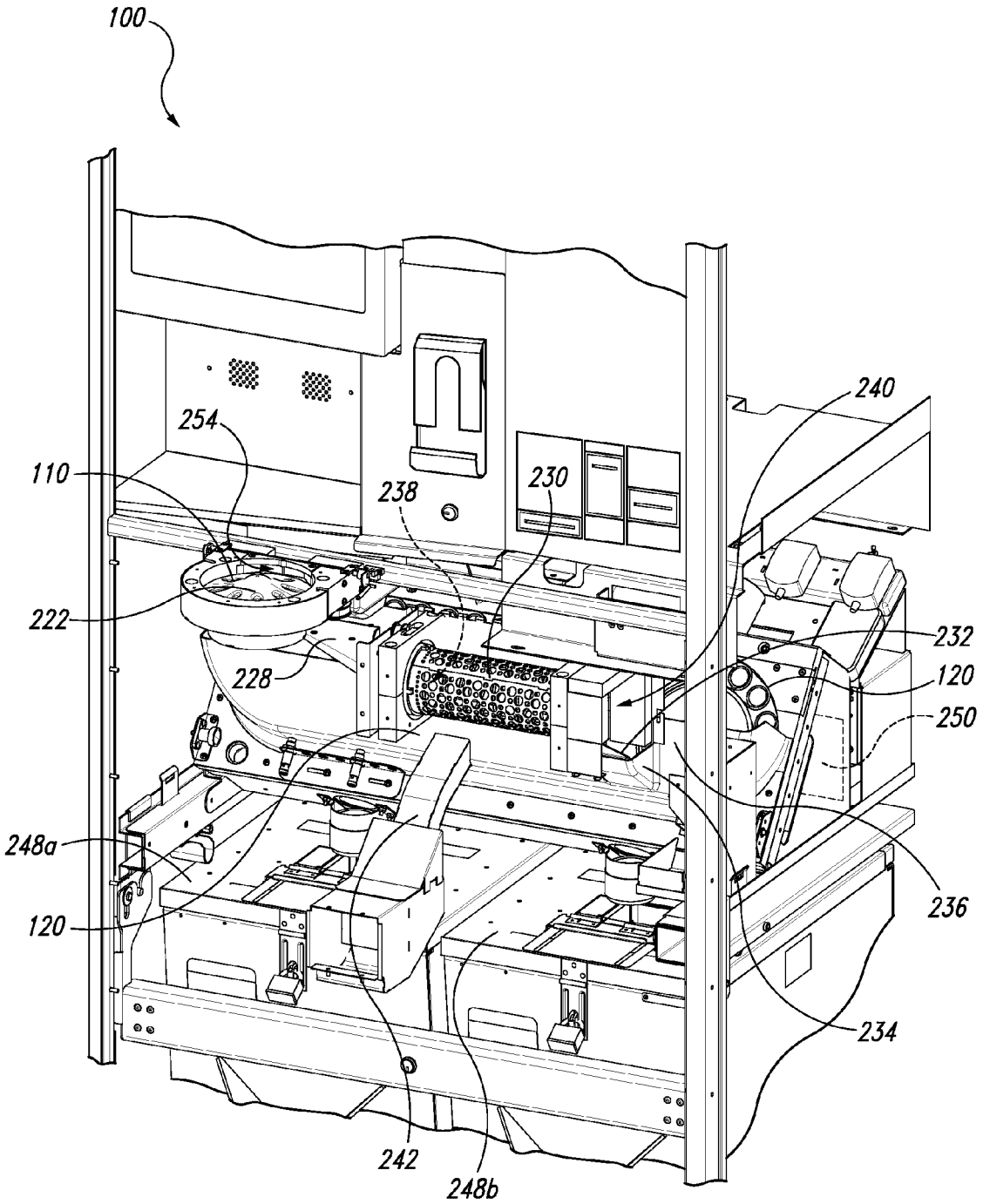
FIG. 2A is an enlarged front isometric view of a portion of the coin counting kiosk of FIG. 1A illustrating a coin input apparatus configured in accordance with an embodiment of the present technology.
Figure 2B:
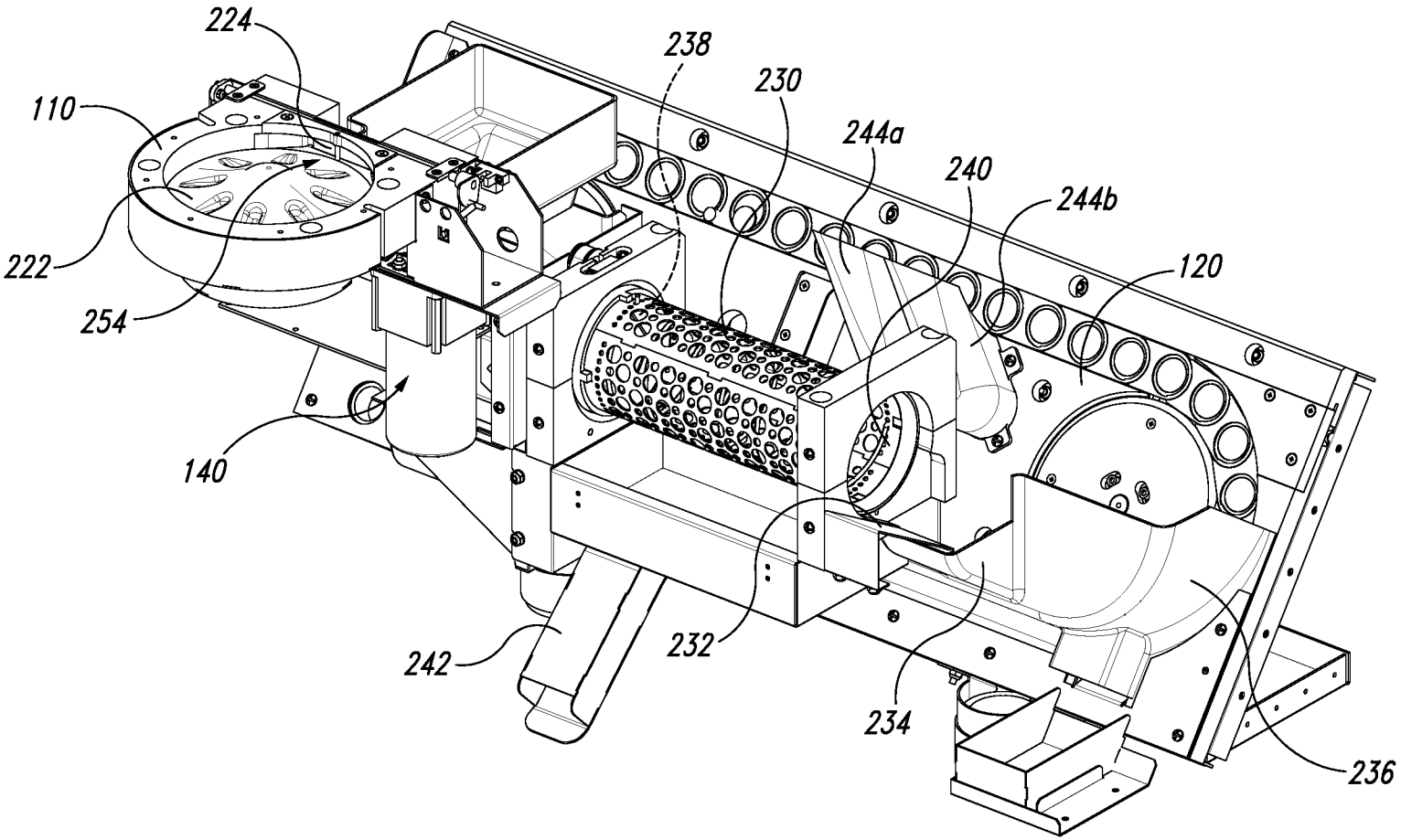
FIGS. 2B and 2C are further enlarged front and rear isometric views, respectively, of the coin input apparatus and an associated coin counting and/or sorting apparatus.
Figure 2C:
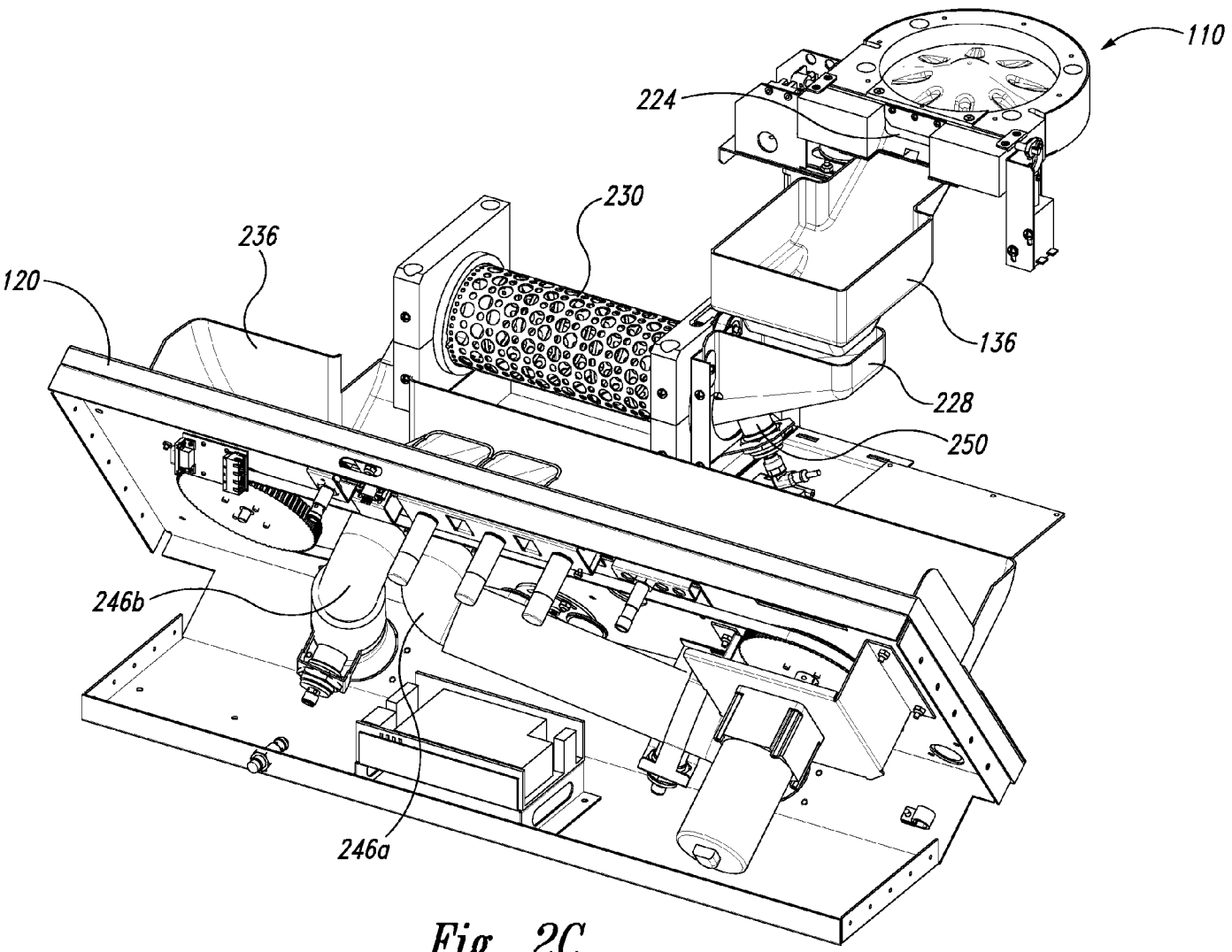

FIG. 2A is an enlarged front isometric view of a portion of the kiosk 100 with selected outer panels and other structures (e.g., the drive system 140) removed for purposes of better illustrating the operational relationship between the coin input tray 110 and the coin processing apparatus 120, in accordance with an embodiment of the present technology. FIG. 2B is a further enlarged front isometric view, and FIG. 2C is a rear isometric view, of the coin input tray 110 and the coin processing apparatus 120. Referring to FIGS. 2A-2C together, the coin input tray 110 includes a rotatable coin disk 222 adjacent to a coin outlet opening 254. As shown in FIG. 2C, a movable gate 224 can obstruct or cover the coin outlet opening 254 when the coin input tray 110 is not in use, and then move (e.g., rotate) away from the opening to clear the coin path for use. As described in greater detail below, in operation the coin disk 222 rotates (e.g., in alternating directions) to move the coins out of the coin input tray 110 and into the funnel 136 though the opening 254. The funnel 136 has downwardly sloping bottom surfaces that direct the coins into a feed hopper 228 having an inlet positioned directly beneath an outlet of the funnel 136. The feed hopper 228 of the illustrated embodiment also includes downwardly sloping bottom surfaces that direct the coins received therein into a coin cleaner 230 through a first opening 238.

In the illustrated embodiment, the coin cleaner 230 can be a rotating drum-type coin cleaner having a plurality of openings in an exterior wall thereof. The openings enable dirt, debris and other unwanted material that may be mixed with the coins to fall out of the rotating drum, thereby cleaning the coins as the coins tumble through the rotating drum. Such coin cleaners can be at least generally similar in structure and function to coin cleaners disclosed in U.S. Pat. No. 6,174,230, which is incorporated herein by reference in its entirety. As the coin cleaner 230 rotates about its longitudinal axis, the rotational movement drives the coins therein from the first opening 238 toward a second opening 240. In the illustrated embodiment, the rotational movement drives the coins out of the coin cleaner 230 and onto a ramp 232, which directs the clean coins into a coin hopper 236 of the coin processing apparatus 120 via an inlet 234. As noted above, the coin processing apparatus 120 can discriminate and count, sort, or count and sort the coins in the manner described in U.S. patent application Ser. No. 13/906,126, which is incorporated herein in its entirety by reference. For example, coins that are properly discriminated and counted can be transferred to one or more removable coin bins 248*a, b* via first and second coin acceptance chutes 244*a, b* (FIG. 2B) which are connected to corresponding coin tubes 246*a, b* (FIG. 2C). Unwanted coins, or coins that cannot be properly discriminated can be transferred to the coin outlet 104 (FIG. 1A) via a suitable coin return chute 242 for collection by the user. Alternatively, if the user elects not to have their coins counted in return for, e.g., a redeemable voucher or other item, the user can decline the service and have all of their coins returned via the coin return outlet 104.

Figure 3A:
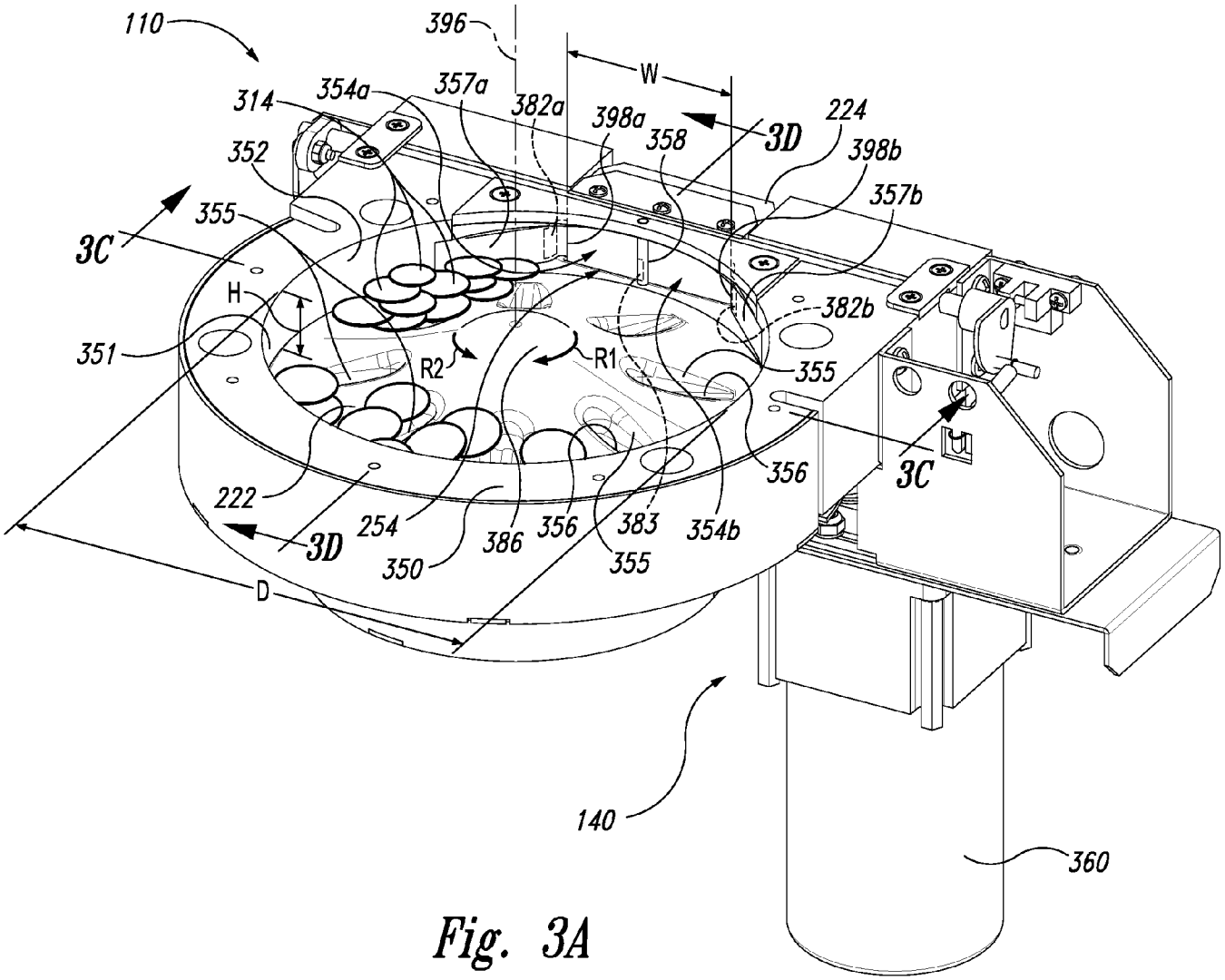
FIGS. 3A and 3B are enlarged top and bottom isometric views, respectively, of the coin input apparatus of FIGS. 2A-2C.
Figure 3B:
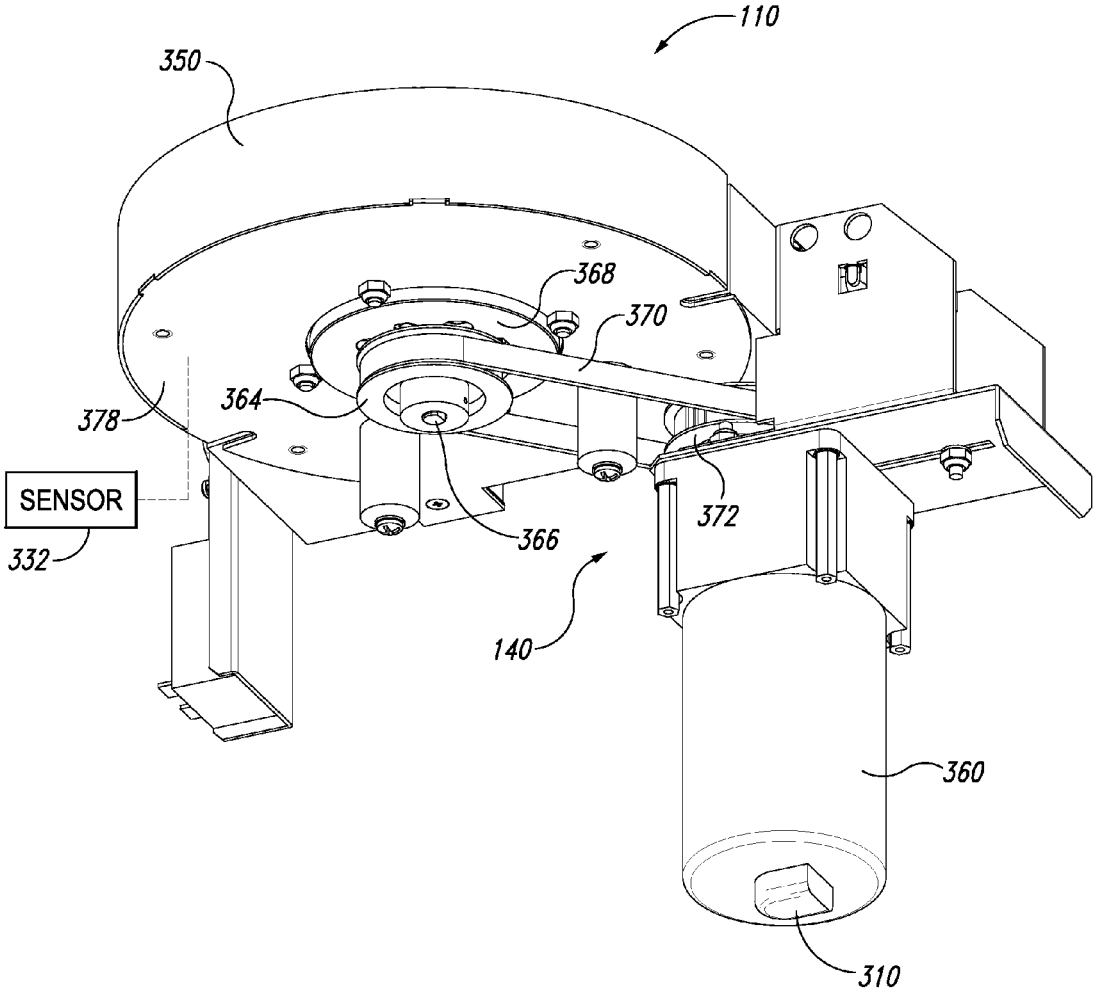

FIG. 3A is an enlarged top isometric view, and FIG. 3B is a corresponding bottom isometric view, of the coin input tray 110 configured in accordance with an embodiment of the present technology. Referring first to FIG. 3A, in the illustrated embodiment the coin disk 222 forms a bottom portion of a coin receptacle or bowl 350. The coin bowl 350 includes a side wall 352 (e.g., a vertical side wall). In the illustrated embodiment, the side wall 352 includes a cylindrically wall portion 351 that extends around a portion of the coin disk 222 proximate an outer edge or periphery of the coin disk 222. In some embodiments, the side wall 352 can have a height H of from about 0.5 inch to about 2 inches or more, or about 0.75 inch; and the coin disk 222 can have a diameter D of from about 3 inches to about 12 inches or more, or about 6 inches. Each end of the cylindrical wall portion 351 transitions into a corresponding angled wall portion 357 (identified as a first angled wall portion 357*a* and a second angled wall portion 357*b*) which extends inwardly toward opposite sides of the coin outlet opening 254. In the illustrated embodiment, the size of the coin outlet opening 254 can be selected to produce favorable coin flow out of the coin input tray 110 while at the same time blocking larger pieces of non-coin items, debris, etc. from passing through the opening and on to, for example, coin cleaner 230. For example, in some embodiments, the coin outlet opening 254 can have a width W from a left boundary 398*a* to a right boundary 398*b* of from about 1 inch to about 6 inches or more, or about 3 inches. As shown in FIG. 3D, the coin outlet opening 254 can also have a height Y from a lower boundary 399*a* to an upper boundary 399*b* of from about 0.25 inch to about 1 inch or more, or about 0.5 inch. In other embodiments, the coin outlet opening can have other width and/or height dimensions. In other embodiments, coin input trays configured in accordance with the present technology can have other diameters, heights, bowl dimensions, shapes, etc. without departing from the present disclosure.

In the illustrated embodiment, the coin disk 222 further includes a plurality of recesses or pockets 355 formed in the outer surface thereof. The pockets 355 extend radially outward from the center of the coin disk 222 toward the periphery of the coin disk 222, and can be symmetrically distributed around the coin disk 222. For example, the illustrated embodiment includes eight coin pockets 355 evenly spaced apart by equal angles of 45 degrees. Each of the pockets 355 can have a bottom surface portion 356 (e.g., a generally horizontal bottom surface portion) that extends at least generally parallel to the plane of rotation of the coin disk 222. The bottom surface portions 356 can also be generally coplanar with the outer periphery of the coin disk 222. The inventor has found that, in certain embodiments, the coin pockets 355 favorably agitate and move the coins out of the coin input tray 110 through the opening 254 during operation. In other embodiments, however, the coin disk 222 can have recesses or pockets with other shapes, and/or the coin disk 222 can have ridges or other raised features. In further embodiments, the pockets 355 and/or other surface features of the coin disk 222 can be omitted.

In one aspect of the illustrated embodiment, the coin input tray 110 includes a structure or member (referred to herein as a coin deflector 358) positioned in front of the coin outlet opening 254. More specifically, in this embodiment, the coin deflector 358 is a cylindrical member, such as a pin that extends vertically across a mid-portion of the opening 254, effectively bifurcating the opening 254 into a first coin outlet passage or path 354*a* on one side of the deflector 358, and a corresponding second coin outlet passage or path 354*b* on the opposite side of the deflector 358. Accordingly, the forgoing structures can provide a dual-path coin exit port through which coins can pass from the coin input tray 110 to downstream apparatuses associated with the kiosk 100 (such as the coin cleaner 230, the coin processing apparatus 120, etc.). In other embodiments, it is contemplated that the deflector 358 can have other shapes (e.g., wedge shapes, rectangular shapes, curved shapes, etc.), and/or the deflector 358 can be a movable or rotatable device of various shapes, such as a roller pin (rather than fixed), or the deflector 358 can be omitted. In this illustrated embodiment, however, the inventor has found that the deflector 358 facilitates efficient transfer of coins out of the coin input tray 110 during operation, as will be described in greater detail below.

Referring next to FIG. 3B, in the illustrated embodiment the drive system 140 includes a drive unit, e.g., a motor 360 (such as a DC electric motor, brushless DC electric motor, an AC motor, or other suitable motor) that is operably coupled to drive the coin disk 222 by means of a drive member 370. More specifically, in the illustrated embodiment the motor 360 can be a DC gear motor fitted with a suitable encoder. The DC motor can be driven by a pulse width modulated (PWM) circuit that allows the speed of the disk 222 to be tuned to a particular rotational speed that best suits its mode of operation. The drive member 370 can be a continuous belt that operably extends around a first pulley 372 fixedly coupled to a driveshaft (not shown) of the motor 360, and a corresponding second pulley 364 which is directly coupled to the coin disk 222 by means of a central shaft 366. The central shaft 366 extends through a bearing 368 (e.g., a slew bearing) which is centrally mounted in a circular opening in a bottom plate 378 of the coin bowl 350. In other embodiments, the motor 360 can operably drive the coin disk 222 by means of other suitable drive members, such as other types of belts (e.g., a timing belt, chain, etc.) and/or a system of suitable gears. In yet other embodiments, the motor 360 can be operably coupled to the central shaft 366 in a direct drive arrangement (e.g., the coin disk 222 can be coupled directly to the drive shaft of the motor 360). All or a portion of the second pulley 364, the drive member 370, and/or other portions of the drive system 140 can be enclosed by a suitable cover, but such a cover has been removed from FIGS. 3B-3D for purposes of illustration.

Referring to FIGS. 3A and 3B together, in operation, the user pours or otherwise puts a plurality of randomly oriented and/or randomly denominated coins 314 into the coin input tray 110 and then depresses a suitable start button (e.g., the start button 132*a* and/or 132*b* shown on FIG. 1A). In other embodiments, the coin input tray 110 can start automatically in response to sensing the placement of the coins 314 into the coin input tray 110. This automatic start capability can be implemented by means of one or more suitable sensors 332 (shown schematically in FIG. 3B) that is operably connected to the coin input tray 110 and/or the coin disk 222 and detects or otherwise senses the placement of coins into the coin input tray 110. Such sensors can include, for example, a suitable vibration sensor, an electromagnetic sensor (e.g., an inductive or capacitive proximity sensor), an infrared sensor (e.g., a sensor that detects a break in an infrared beam), an acoustic sensor (e.g., a microphone or sonic-based switch), an electrical continuity sensor, as well as other types of sensors. In some embodiments, in response to the user depressing the start button or the coin intake process otherwise starting, the gate 224 moves (e.g., rotates) to the "open" position as shown in FIG. 3A to unblock the coin outlet opening 254 (or, more specifically, the first coin path 354*a* and the second coin path 354*b* through the opening 254). Additionally, when the process starts the drive system 140 is energized and the motor 360 begins rotating the coin disk 222 in a first direction (e.g., a first direction R1) about its central rotational axis 396 (e.g., a vertical axis of rotation). In some embodiments, after a preset period of time, the motor 360 automatically stops and begins rotating the coin disk 222 in an opposite direction R2. For example, in those embodiments in which the motor 360 includes a DC motor, the voltage applied to the DC motor can be stopped and then reversed to run the motor in the opposite direction and rotate the disk 222 in the opposite direction R2. In other embodiments, the user can control all or portion of coin disk operation. For example, in some embodiments the user can depress the start button 132*a* (or 132*b*) and hold it down to keep the coin disk 222 rotating in one direction, lift their finger momentarily to stop disk rotation, and then depress the start button again to rotate the coin disk 222 in the opposite direction. In some such embodiments, the coin disk 222 can rotate in a given direction for as long as the user depresses the start button. In this way, the user can alter the direction and/or duration of time that the coin disk 222 rotates in any given direction. In some embodiments, the coin disk 222 can be configured to rotate at about 45 revolutions per minute (RPM) in both directions R1 and R2. In other embodiments, the coin disk 222 can be configured to rotate at other speeds.

As the coin disk 222 rotates in the first direction R1, it drives the coins 314 outwardly toward its periphery and out of the coin input tray 110 via the coin outlet opening 254. More specifically, in the illustrated embodiment, rotation of the coin disk 222 in the first direction R1 drives the coins 314 out of the coin input tray 110 via the first coin path 354*a* (i.e., through the opening formed between the coin deflector 358 and the left side wall of the coin outlet opening 254). The inventor has found that by rotating the coin disk 222 in a first direction (e.g., the first direction R1), the coin disk 222 can feed the coins 314 out of the coin input tray 110 through, for example, the first coin path 354*a* while simultaneously clearing any coin jams that may have occurred at the entrance to the second coin path 354*b*. Similarly, reversing the coin disk 222 and rotating in the second direction R2 enables the coin disk 222 to feed the coins 314 through the coin outlet opening 254 via the second path 354*b*, while simultaneously clearing any coin jams that may have developed at the entrance to the first coin path 354*a*. This dual coin exit path feature can enable the coin disk 222 to efficiently transfer the coins 314 from the coin input tray 110 without having coin jams occur at the coin outlet opening 254 (which may unfavorably require the user to manually clear). This feature can also prevent debris (e.g., hair, clothing, etc.) from becoming entangled with the disk 222 and/or the drive system 140, as could otherwise occur if the disk 222 rotated in a single direction.

In some embodiments, rotation of the coin disk 222 in the first direction R1 drives the coins 314 out of the coin input tray 110 via the first coin path 354*a* but not the second coin path 354*b*, and rotation of the coin disk 222 in the second direction R2 drives the coins 314 out of the coin input tray 110 via the second coin path 354*b* but not the first coin path 354*a*. In other embodiments, it is contemplated that rotation of the coin disk 222 in the first direction R1 may drive the coins 314 out of the coin input tray 110 via the first coin path 354*a* and the second coin path 354*b*, and rotation of the coin disk 222 in the second direction R2 may drive the coins 314 out of the coin input tray 110 via the second coin path 354*b* and the first coin path 354*a*.

In one aspect of the illustrated embodiment, the coin input tray 110 can include one or more sensors (e.g. proximity sensors, activity sensors, etc.) positioned proximate the entrance to one or both of the coin outlet paths 354 to detect whether coins have stalled or otherwise become jammed at the coin outlet opening 254. In one embodiment, for example, the sensors can be composed of first activity sensors 382*a, b* positioned on opposite sides of the coin outlet opening 254, which work in combination with a second activity sensor 383 positioned, for example, on the coin deflector 358 (FIG. 3A). In one embodiment, the activity sensors 382 and 383 can be comprised of metallic plates configured to detect electrical continuity between the plates. In operation, the plates can detect the electrical continuity produced by coins positioned at either the entrance to the first coin path 354*a* or the entrance to the second coin path 354*b*, and then cause the disk 222 (via, e.g., a controller and a software routine, as described in detail below) to rotate in the opposite direction (e.g., backward relative to the coin path (354*a* or 354*b*) which is jammed) to clear the jam or other blockage. In other embodiments, other types of sensors can be provided proximate the exit opening 254 of the coin input tray 110; and/or other sensors can be operably coupled proximate to the coin cleaner 230 and/or the coin processing apparatus 120 to detect jams and/or other activity associated with those apparatuses. For example, a coin flow sensor 250 (e.g., an electromagnetic inductive sensor) can also be positioned in contact with or proximate a lower portion of the coin feed hopper 228 proximate the inlet to the coin cleaner 230. Such sensors can include, for example, electromagnetic sensors (e.g., inductive or capacitive sensors), electrical continuity sensors, optic sensors (e.g., an infrared sensor), acoustic sensors (e.g., a microphone, sonic based switch, etc.), etc. The sensor 250 can detect coins flowing out of the coin input tray 110 and send signals to a controller (described below) corresponding to whether the coin flow is high, medium, low, none, jammed, etc. As described below, in some embodiments the controller can control operation of the coin input tray 110, the coin cleaner 230, the coin processing apparatus 120, and/or other related apparatuses and systems based on the signals from the sensor 250, and/or the sensors 382/383. In the other embodiments, proximity/activity/jam sensors proximate the coin exit opening 254, the coin cleaner 230 and/or the coin processing apparatus 120 can be omitted.

As described in greater detail below, the coin input tray drive system 140 can be operably connected to a suitable controller having, e.g., configurable software that controls the voltage and/or current provided to the motor 360 to ensure that a high current draw produced by, for example, a coin jam will not damage the DC motor and/or other components of the drive system 140. The system can also include a high limit non-adjustable hardware current threshold. In one embodiment, tripping the threshold will result in the coin input tray control system performing a pre-defined de-jam routine (e.g., by driving the disk 222 in opposite directions) to clear the jam. Moreover, in those embodiments in which the motor 360 includes an electric motor (e.g., a DC motor), the motor can include an encoder 310. If the encoder 310 indicates that the disk 222 is jammed, the encoder 310 can cause the coin transaction to pause, or terminate, until the jam can be cleared (e.g., manually cleared).

Figure 3C:
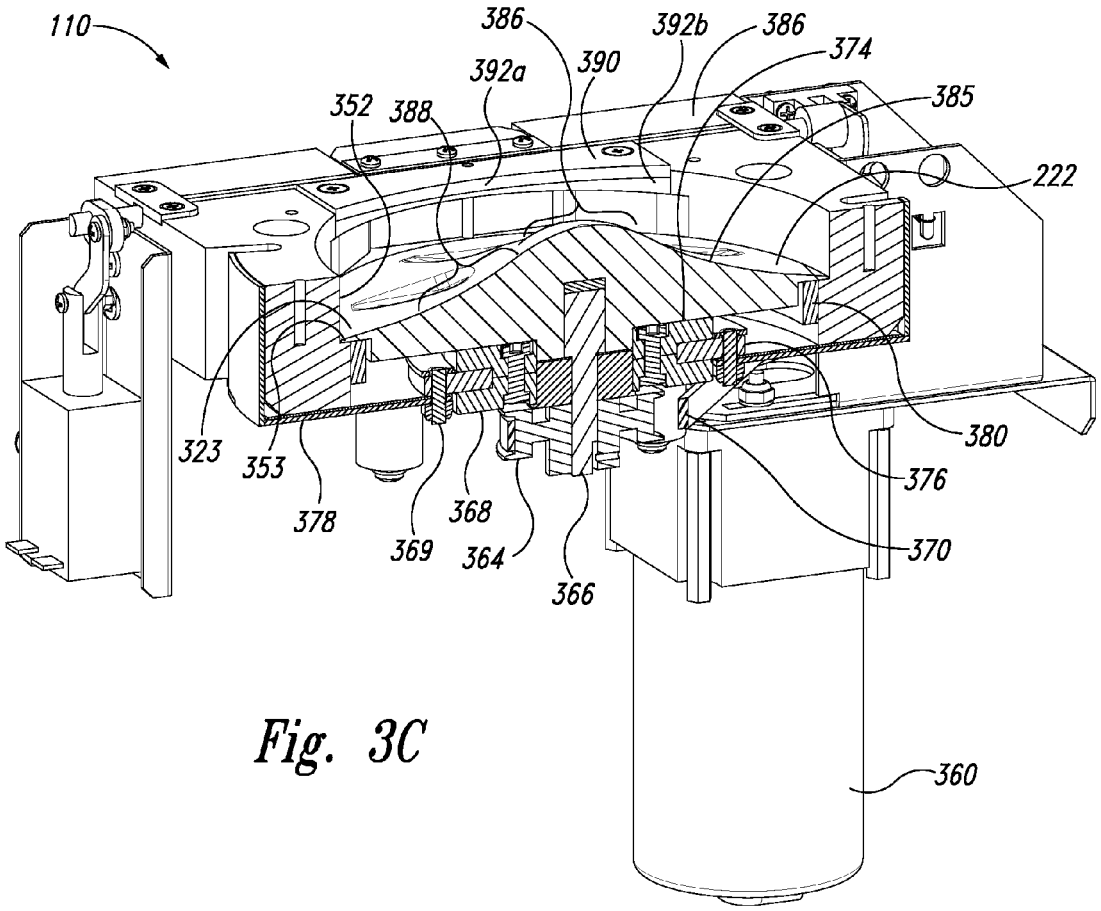
FIG. 3C is a cross-sectional isometric view.
Figure 3D:
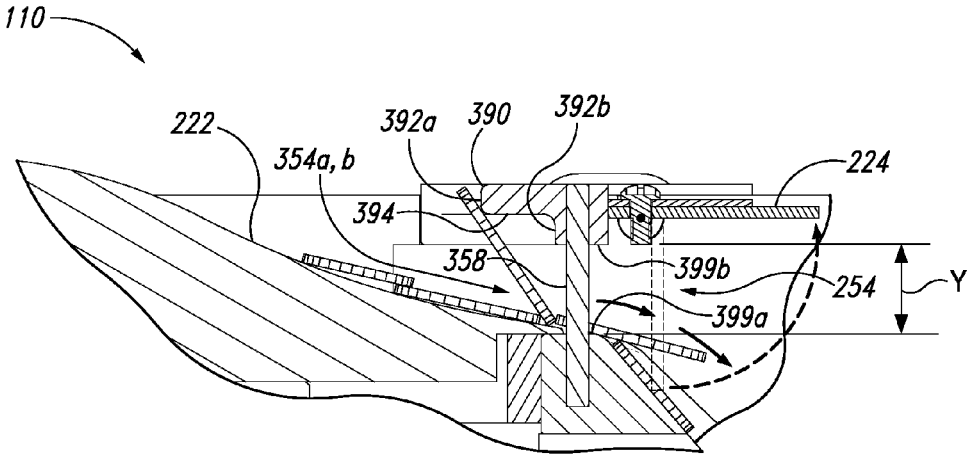
FIG. 3D is an enlarged cross-sectional side view.
Figure 3E:
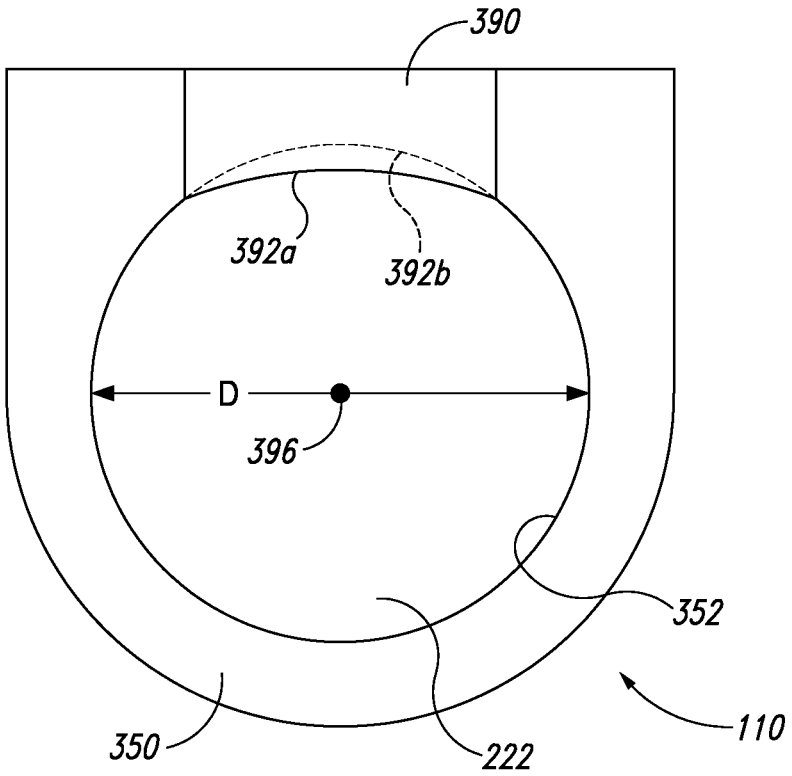
FIG. 3E is a top view of the coin input apparatus configured in accordance with embodiments of the present technology.

FIG. 3C is a cross-sectional isometric view taken substantially along lines 3C-3C in FIG. 3A, FIG. 3D is a cross-sectional side view taken substantially along line 3D-3D in FIG. 3A, and FIG. 3E is a top view of a portion of the coin input tray 110. Referring first to FIG. 3C, in the illustrated embodiment the coin disk 222 is circular and has an upper surface 385 with a generally cone-shaped cross-section defined by a raised center portion 386 and a slightly curved annular surface portion 388. More specifically, in the illustrated embodiment the generally annular surface portion 388 is slightly recessed or concave to give the surface portion 388 a gentle "S" curve. In one aspect of this embodiment, this particular contour can facilitate movement of the coins toward the outer periphery of the coin disk 222, especially if the coins are wet, sticky, etc. In other embodiments, the coin disk 222 can have other cross-sectional shapes. For example, the coin disk 222 can have a generally conical shape (e.g., a shallow conical shape) with a raised and/or rounded center portion 386 and a relatively straight annular surface portion extending toward the periphery of the disk 222. In other embodiments, it is contemplated that the coin disk 222 can have a generally flat cross-sectional shape. Accordingly, the various aspects of the technology described herein are not limited to coin input disks having a particular cross-sectional shape.

As also illustrated in FIG. 3C, in the illustrated embodiment the coin disk bearing 368 can be, e.g., a ball bearing-free slew bearing for noise reduction and to enable the coin disk 222 to carry a relatively high axial load of coins. Such bearings include, for example, the PRT 02-30-AL-1 bearing provided by Igus® GmbH of Spicher Str. 1a 51147 Cologne, Germany. The bearing 368 can include a rotating center portion 374 to which the second pulley 364 and central shaft 366 are fixedly attached, and an outer flange portion 376 that is fixedly attached to the bottom plate 378 of the coin input tray 110 via, for example, a plurality of suitable fasteners 369 (e.g., bolts, screws, etc.). The central shaft 366 extends through the bearing center portion 374 and engages the coin disk 222, enabling the coin disk 222 to rotate freely in either direction when driven by the motor 360 via the drive member 370. An outer peripheral portion 323 of the coin disk 222 is slidably supported on an annular support surface or step 353 positioned proximate a lower portion of the coin bowl side wall 352. In the illustrated embodiment, the step 353 can extend in a complete circle around the underside of the coin disk 222. In other embodiments, the step 353 can only extend a portion of the way, or portions of the way, around the coin disk 222. Additionally, a circumferential seal 380 (e.g., a felt seal) is attached to the side wall 352 directly adjacent to the step 353 to seal the disk bowl and channel water and/or other undesirable substances to an appropriate collection area.

As shown in FIG. 3C, the coin input tray 110 can include a header member 390 which forms a portion of the coin bowl 350 and extends over the coin outlet opening 254. In the illustrated embodiment, the header member 390 can include a first side wall portion 392*a* and a second, recessed side wall portion 392*b*. As shown in FIGS. 3C and 3E, both the first and second side wall portions 392*a, b* blend or otherwise smoothly transition into the adjacent portions of the side wall 352 of the coin bowl 350 on opposite ends thereof. As shown by reference to FIGS. 3C-3E together, in the illustrated embodiment both side wall portions 392*a, b* have cylindrical shapes, however, the first side wall portion 392*a* has a cylindrical shape of larger diameter than the second side wall portion 392*b*. For example, in the illustrated embodiment the second side wall portion 392*b* can have a diameter that is the same as, or is at least complementary to, the diameter D of the coin bowl 350 as defined by the coin bowl side wall portion 352 (FIG. 3A). Accordingly, in this embodiment the coin bowl side wall portion 352 in combination with the second side wall portion 392*b* of the header member 390 defines a circle centered about the rotational axis 396 of the coin disk 222. As mentioned above, however, the first side wall portion 392*a* of the header member 390 can have a larger diameter than the coin bowl 350, thereby defining a step 394 (FIG. 3D) in the header member 390 positioned directly above the coin outlet paths 354*a, b*. The inventor has found that providing the step 394 in the header member 390 can facilitate efficient movement of the coins 314 out of the coin input tray 110 via the coin outlet paths 354*a, b* during operation. For example, in some embodiments coins 314 may stand up vertically on edge and be supported by the side wall 352 during rotation of the coin disk 222. Without the step 394, these vertical standing coins 314 can occasionally block coin outlet opening 254 and prevent other coins that may be lying flat from exiting the coin bowl 350 via the coin outlet paths 354*a, b*. The stepped header member 390, in some embodiments, can cause the top of coins 314 that are vertically oriented to tip inwardly toward the center of the coin disk 222 as they pass across the opening 254. The weight of the flat-lying coins 314 can then push the bottom portions of the vertically oriented coins 314 outwardly, causing them to tip over and pass through the opening 254 via one of the outlet paths 354*a* or 354*b*. In some embodiments, the inventor has found that absent this step feature 394 vertically oriented coins 314 could potentially pass by the opening 254 and continue around the perimeter of the coin bowl 350 while blocking other flat-lying coins from exiting. Moreover, this feature may be most effective when the coin bowl 350 is full of coins 314 so that the weight of the coin mass holds the vertical coins firmly against the bowl wall. Accordingly, in such embodiments the stepped feature 394 can cause such coins to efficiently move out of the coin bowl 350 via the coin outlet paths 354*a, b.*

Figure 4:
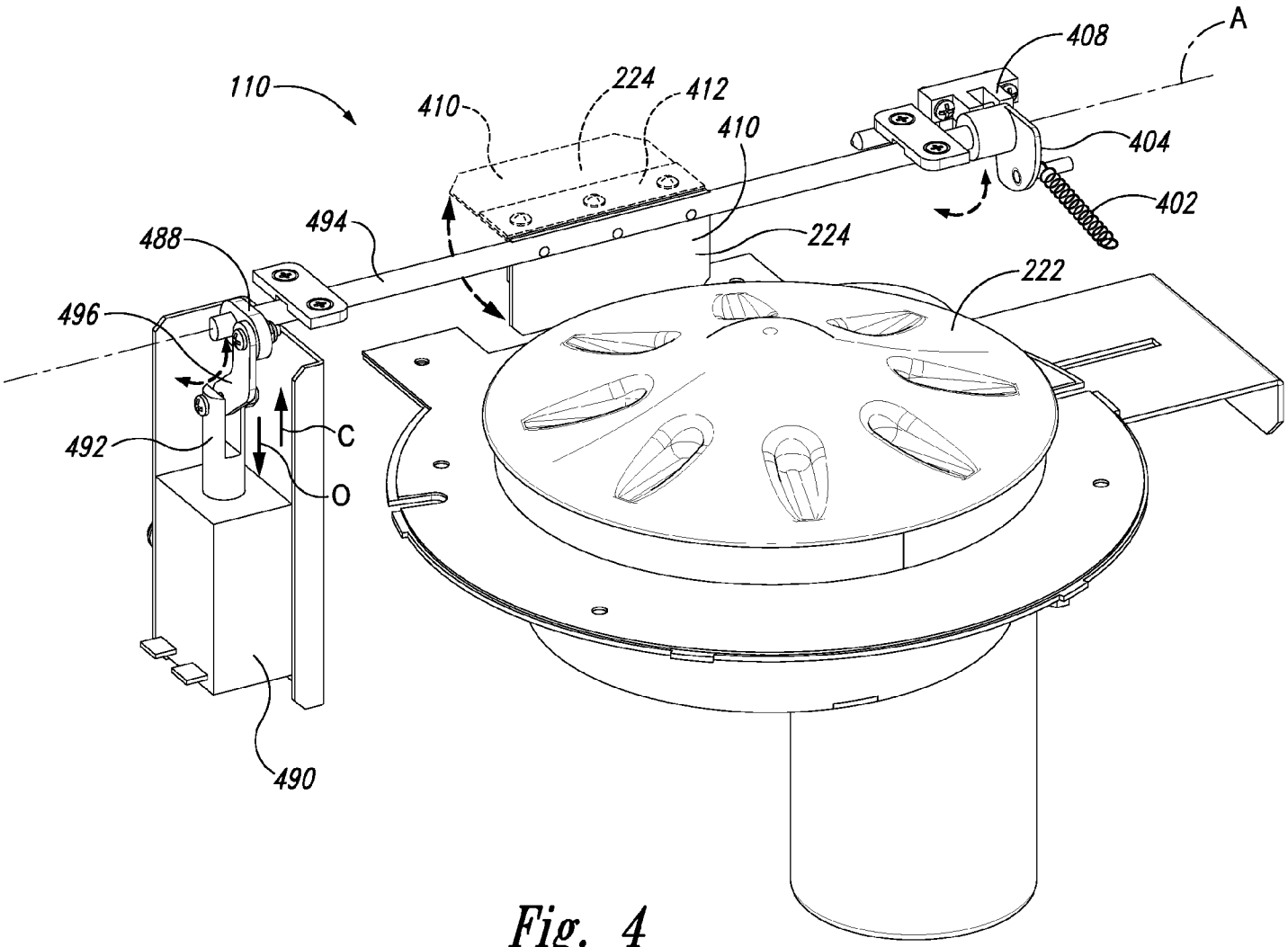
FIG. 4 is an enlarged top isometric view of the coin input apparatus of FIGS. 2A-3D, with selected surrounding structures removed for purposes of illustration.

FIG. 4 is an isometric view of the coin input tray 110 with selected structures (e.g., portions of the coin bowl 350) removed to better illustrate the structure and function associated with the coin gate 224. In the illustrated embodiment, the coin gate 224 is fixedly attached to an elongate pivot shaft 494 which has its end portions rotatably supported by journals or other suitable structures (not shown) relative to the coin disk 222. In some embodiments, the gate 224 can be rectangular shaped and include a relatively flat member 410, e.g., a flat rubber member, which is fixed to the pivot shaft 494 by means of a metal bracket 412, or a similar member, and one or more suitable fasteners. The pivot shaft 494 extends longitudinally along a pivot axis A and is configured to rotate thereabout. In the illustrated embodiment, an actuator 490 (e.g., a pull-type solenoid) is mounted adjacent to the coin bowl 350, and is operably coupled to the pivot shaft 494 by means of a linkage 496 and a pull rod 492. In some embodiments, the actuator 490 can be a pull-type solenoid, such as the 11HD-C-12D A420-065762-01 solenoid provided by Guardian Industrial Supply, LLC, of 2012 Centimeter Circle Austin, Tex. 78758. The linkage 496 can be pivotably coupled to a first arm 498 that extends from a first end portion of the pivot shaft 494. A biasing member 402 (e.g., a coil spring, extension spring, etc.) can be operably coupled to a second arm 404 at an opposite second end portion of the pivot shaft 494 to bias the coin gate 224 toward the closed position (as shown by the depiction of the gate 224 in solid lines in FIG. 4).

In operation, the input tray controller (described in more detail below) can send one or more signals energizing the actuator 490 and causing the actuator 490 to withdraw the pull rod 492 in direction O. Retracting the pull rod 492 in this manner rotates the first arm 498 downwardly which in turn rotates the coin gate 224 upwardly toward the open position (shown by phantom lines in FIG. 4). In one embodiment, the actuator 490 can be a solenoid that requires, e.g., a 24 VDC kicker pulse that lasts for, e.g., 500 milliseconds, and then requires a continuous 12 VDC holding voltage to hold the gate 224 in the open position. When in the open position, the biasing member 402 can apply a tension force to the second arm 404 which urges the gate 224 toward the closed position. In some embodiments, the coin input tray 110 can include a sensor 408, such as an infrared position sensor (or other type of sensor) to detect the position of the gate 224. For example, in the illustrated embodiment the second arm 404 can serve as a position flag that moves into position adjacent the sensor 408 and is detected by the sensor 408 when the gate 224 rotates to the open position. At the conclusion of the coin input process, the controller can send a signal or otherwise de-energize the actuator 490, causing the pull rod 492 to return upwardly in direction C, thereby rotating the gate 224 downwardly to the closed position, assisted by the biasing member 402.

Figure 5:
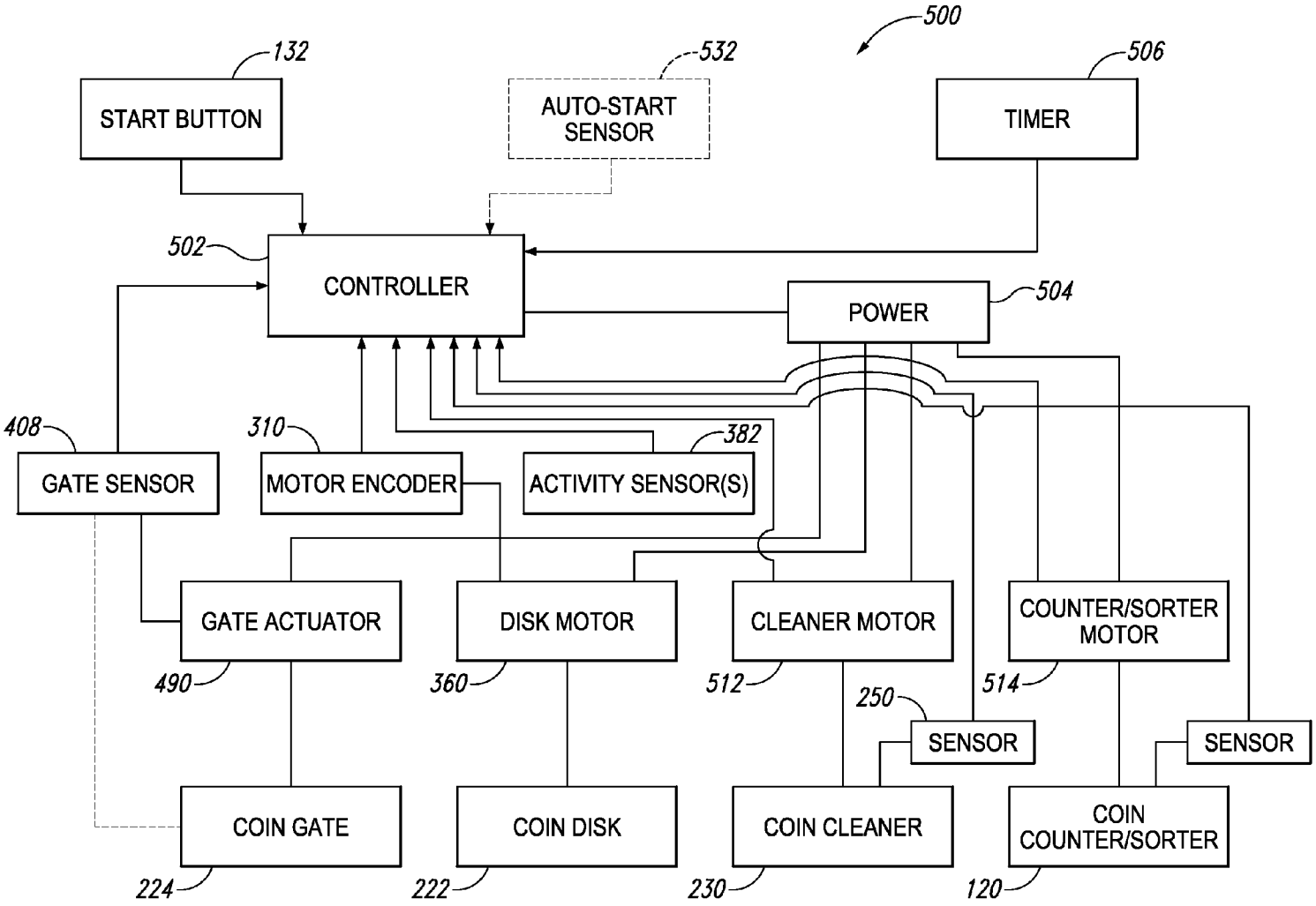
FIG. 5 is a block diagram of a suitable system for operating a coin input apparatus configured in accordance with the present technology.

FIG. 5 is a schematic diagram of a system 500 for controlling operation of the coin input tray 110 and related apparatuses and systems described in detail above, in accordance with an embodiment of the present technology. Various aspects of the system 500 are performed by a controller 502. The controller 502 can be embodied in a special purpose computer or data processor that is specifically programmed, configured, or otherwise constructed to perform one or more of the computer-executable instructions or routines described herein. The controller 502 can include, e.g., a programmable logic controller (PLC), a printed circuit board (PCD) carrying various processing and/or memory devices, etc. Aspects of the controller can be described in the general context of computer-executable instructions, such as routines executed by a general-purpose data processing device. The controller 502 can include computer-readable storage media that contain computer-executable instructions for causing the various subsystems of the apparatuses and systems described herein to perform the operations and methods described herein. While aspects of the present technology, such as certain functions associated with the coin input tray 110, may be described as being performed exclusively on a single device, the technology can also be practiced in distributed environments where functions or modules are shared among disparate processing devices, which may or may not be linked. The various routines and functions described herein may be stored or distributed on tangible computer-readable media, including magnetically or optically readable computer discs, hardwired or preprogrammed chips (e.g., EEPROM semiconductor chips, etc.), nanotechnology memory, and/or other data storage media. Alternatively, computer implemented instructions, data structures, and other data associated with aspects of the present technology may be distributed over a network.

In the illustrated embodiment, the controller 502 can receive a start signal from the start button 132*a, b* described above and shown in, e.g., FIG. 1A. In other embodiments, the controller 502 can receive a start signal from an auto-start sensor 532. As described above, the auto-start sensor 532 can include a vibration sensor, an infrared sensor, an electromagnetic sensor, and/or other type of sensor that automatically starts operation of the coin disk 222 and/or other operations of the kiosk 100 (e.g., the coin cleaner 230 and/or the coin processing apparatus 120). Additionally, the system 500 can include a digital clock or timer 506 operably providing input to the controller 502 during operation of the various kiosk systems. In the illustrated embodiment, the controller 502 can control power provided to one or more of the gate actuator 490, the coin disk motor 360, a coin cleaner motor 512, and/or a coin processing apparatus motor 514 by a power source 504 (e.g., an electric power source, such as facility power, on-board kiosk power (provided by, e.g., a battery or transformer), etc.). As described above, a gate sensor 508, (e.g., an infrared position sensor) can be operably coupled to the gate actuator 490 and/or the coin gate 224 to determine gate position and send a corresponding signal to the controller 502. The motor encoder 310 (e.g., an incremental rotary encoder, such as the E4P-200-236-N-S-D-M-B encoder provided by US Digital of 1400 NE 136th Avenue Vancouver, Wash. 98684), can be operably coupled to the disk motor 360. More specifically, as known to those of ordinary skill in the art, the encoder 310 can provide an electrical signal that can be used to monitor and/or control the speed, position, and/or direction of the output shaft of the disk motor 360. The encoder 310 alone and/or in conjunction with the controller 502 can be used to then make adjustments to the speed, position, and/or direction of the motor shaft if necessary to provide or maintain desired movement of the coin disk 222 as described above. The coin cleaner motor 512 and/or the coin processing apparatus motor 514 can include similar encoders to provide various operating parameters to the controller 502 during operation of the associated systems.

As described above, in one embodiment, the user can depress the start button 132*a, b* to begin a coin intake process using the coin input tray 110. (Alternatively, the coin input tray can start automatically in response to a signal from the auto-start sensor 532). The controller 502 can respond to the signal by providing power from the power source 504 to the disk motor 360, the gate actuator 490, the cleaner motor 512 and/or the coin processing apparatus motor 514. As a result, the gate actuator can open the gate 224 (see e.g., FIG. 4) and the motor 360 can begin rotation of the coin disk 222. As the motor 360 rotates the coin disk 222, the encoder 310 can send direction, velocity, and/or position information to the controller 502. The controller 502 can respond to the information by stopping the disk motor 360 after a preset period of time (or a preset number of rotations) and/or by pausing the motor momentarily, before starting rotation of the coin disk 222 in the opposite direction. As rotation of the coin disk 222 moves coins through the opening 224, past the open gate 224 and to the coin cleaner 230, the cleaner motor 512 rotates the coin cleaner 230 and provides clean coins to the coin processing apparatus 120 for discrimination and counting and/or sorting.

If the controller 502 receives information indicating that there is an excess current draw to, e.g., the disk motor 360, the controller 502 can reverse the voltage from the power source 504 to cause the motor 360 to rotate in the opposite direction in an attempt to clear or unjam the coin disk 222. Similarly, the controller 502 can also reverse the direction of coin disk 222 if, for example, the activity sensor(s) 382/383 indicate that there is a coin jam proximate the coin outlet opening 254 (FIG. 3A). Additionally, if the sensor 250 senses that the flow of coins to the coin cleaner 230 is too high and/or is clogged, the controller 502 can cut power to the disk motor 360 and simultaneously cause the gate actuator 490 to close the coin gate 224 so that no further coins are transferred to the coin cleaner 230 until the jam or other issue is resolved. Similarly, if the controller 502 senses that the coin cleaner motor 512 is drawing too much current, indicating that the coin cleaner 230 could be jammed or otherwise immobilized, the controller 502 can cut power to the disk motor 360 and simultaneously cause the gate actuator 490 to close the coin gate 224 so that no further coins are transferred to the coin cleaner 230 until the jam or other malfunction of the coin cleaner is cleared. In one embodiment, the jam in the coin cleaner may be cleared or otherwise resolved by reversing the voltage provided from the power source 504 to the coin cleaner motor 512, thereby causing the coin cleaner 230 to rotate in a counter direction to dislodge the jammed coins or other matter. Similarly, if the controller 502 senses that the coin processing apparatus motor 514 is drawing too much current or is otherwise experiencing a jam in the coin processing apparatus 120, the controller 502 can send similar signals to the gate actuator 490, the disk motor 360, and/or the coin cleaner motor 512 causing them to stop operation until the jam or other malfunction of the coin processing apparatus 120 is resolved. As those of ordinary skill in the art will appreciate, the system 500 described above as well as the corresponding functions are provided by way of non-limiting example of one system architecture and/or functions for controlling operation of the coin input tray 110 and associated apparatuses and systems described above. Accordingly, in other embodiments, other power, control, signal, data, and/or other systems can be used to control these apparatuses without departing from the spirit or scope of the present technology.

Figure 6A:
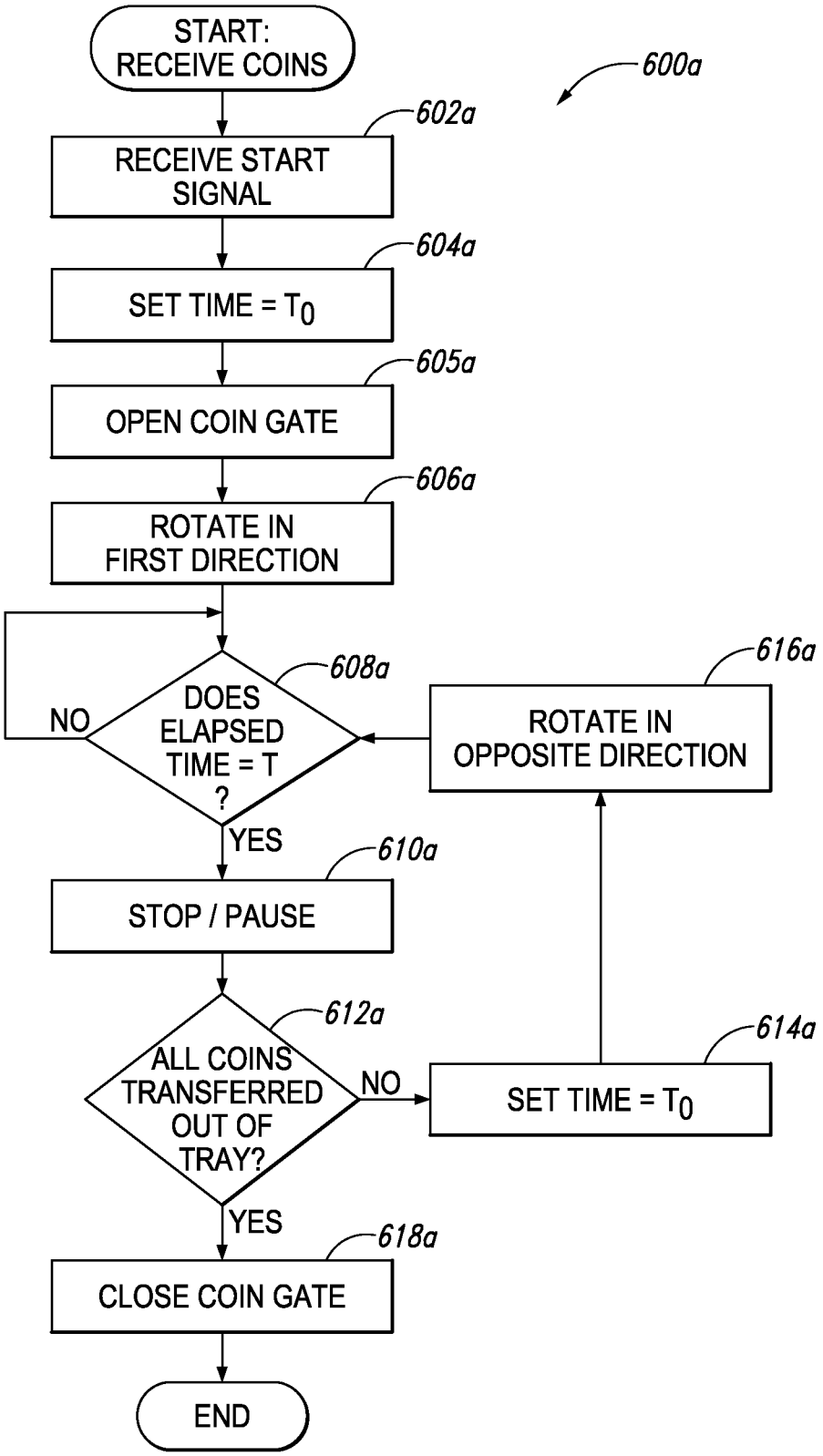
FIGS. 6A-6C are a series of flow diagrams illustrating routines for operating a coin input apparatus configured in accordance with embodiments of the present technology.
Figure 6B:
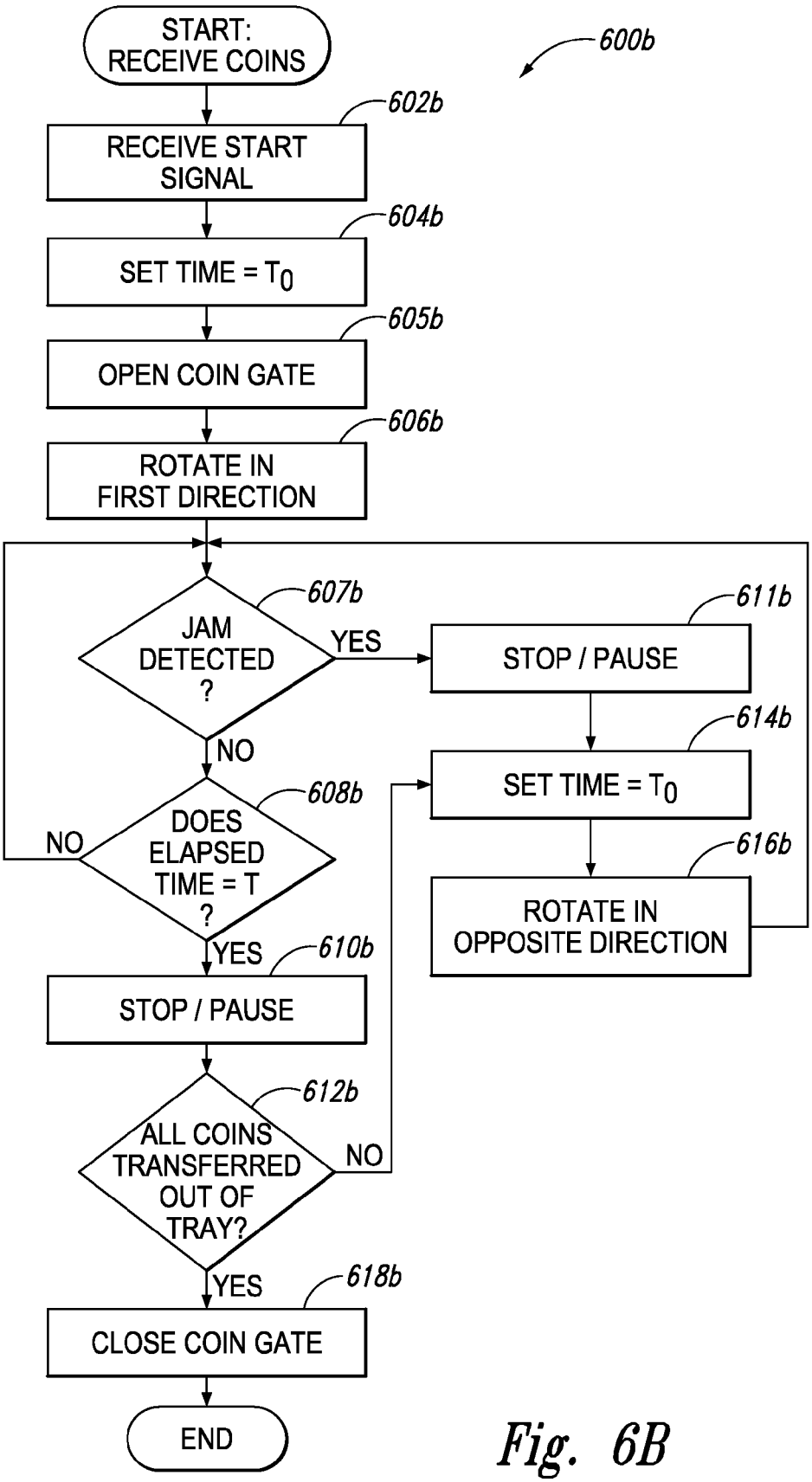
Figure 6C:
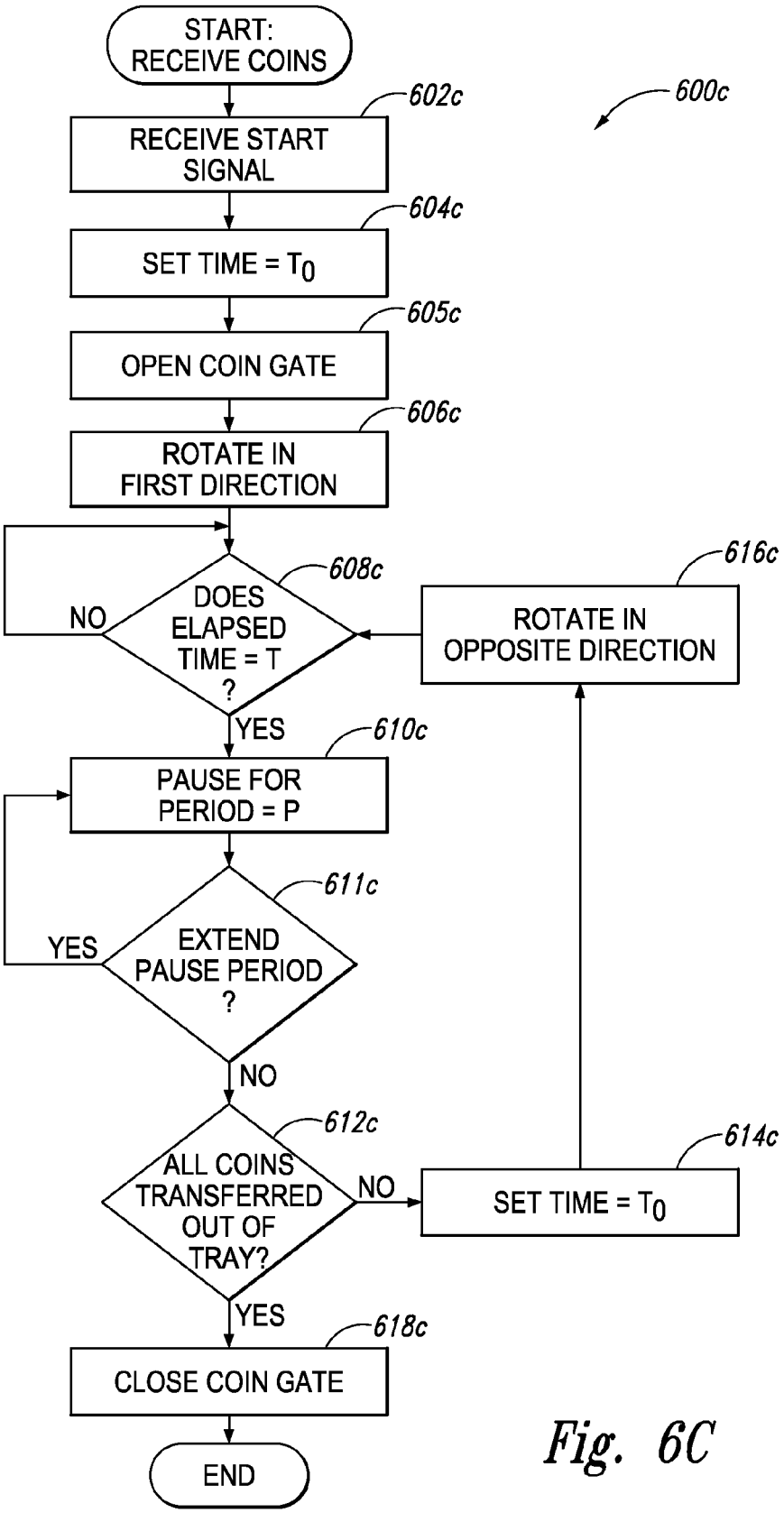

FIGS. 6A-C are representative flow diagrams illustrating routines 600*a*-600*c* for operating the coin input tray 110 and associated systems in accordance with embodiments of the present technology. In some embodiments, the routines 600*a-c* or portions thereof can be performed by the controller 502 (FIG. 5) in accordance with computer-executable instructions. In other embodiments, the routines 600*a-c* or portions thereof can be performed by other data processing devices associated with the kiosk 100. The routines 600*a*-600*c* do not necessarily show all functions or exchanges of data, but instead provide an understanding of various steps, commands, and/or data exchanges that can be utilized in accordance with the present technology. Accordingly, those of ordinary skill in the art will understand that some functions or exchange of commands and/or data may be repeated, varied, or omitted or supplemented, and/or other potentially less important aspects of the technology not shown may be readily implemented. Additionally, those of ordinary skill in the art will understand that various portions from one or more of the routines 600*a*-600*c* can be combined with portions from other of the routines 600*a*-600*c* to create other useful routines for operating the coin input tray 110. Moreover, each of the steps depicted in the routines 600*a*-600*c* can itself include a sequence of operations that need not be described herein. While processes or blocks are presented in a given order, alternative implementations may perform routines having steps, or employ systems having blocks, in a different order, and some processes or blocks may be deleted, moved, added, subdivided, combined, and/or modified to provide alternative or sub-combinations. Each of these processes or blocks may be implemented in a variety of different ways. Also, while processes or blocks are at times shown as being performed in series, these processes or blocks may instead be performed or implemented in parallel, or may be performed at different times.

Referring first to FIG. 6A, the routine 600*a* begins when a user pours or otherwise deposits a batch of coins into the coin input tray 110. In block 602*a*, the routine receives a start signal (e.g., by the user depressing a start button). In block 604*a*, the routine sets a time equal to $T_0$, and in block 605*a*, the routine opens the coin gate 224. In block 606*a*, the coin disk 222 begins rotating in a first direction and at a speed (e.g., a preset speed, such as 45 RPM). In decision block 608*a*, the routine determines if the coin disk 222 has been rotating in the first direction for an elapsed time equal to T. In some embodiments, the elapsed time T can be equal to a period of time between 0.5 second and 3 seconds, such as 2 seconds. In other embodiments, the coin disk 222 can be configured to rotate in one direction for other periods of time (and/or for selected or preset numbers of revolutions). If the coin disk 222 has not rotated for the period T, the coin disk 222 continues rotating in the first direction. Conversely, if the elapsed time is equal to T, then the coin disk 222 stops as noted in block 610*a*. In some embodiments, the coin disk can pause in the stop position for a preset period of time, such as a time period from about zero seconds to about 2 seconds, or about 1 second. In decision block 612*a*, the routine determines if all of the coins that were put into the tray by the user have been transferred out of the tray through the exit opening. If so, the routine closes the gate 224 in block 618*a* and then ends. If not, the routine proceeds to block 614*a* and resets the time equal to $T_0$. In block 616*a*, the routine then begins rotating the coin disk 222 in the opposite direction, and continues to decision block 608*a* and proceeds as described above. In the foregoing manner, the coin disk 222 can alternately rotate in opposite directions until all of the coins have been transferred out of the coin input tray 110.

Turning next to FIG. 6B, the flow routine 600*b* describes a process for operating the coin input tray 110 and related systems in accordance with another embodiment of the present technology. The routine begins when the coins are poured into the coin input tray 110 and a start signal is received in block 602*b*. In block 604*b*, the time is set to $T_0$. In block 605*b*, the coin gate 224 is opened, and in block 606*b*, the coin disk 222 begins rotating in a first direction. In decision block 607*b*, the routine determines if there is a jam (e.g., a coin jam) somewhere in the system. For example, a coin jam could be detected at the coin outlet opening 254 of the coin input tray 110, at the coin cleaner 230, and/or at the coin processing apparatus 120. If a coin jam is detected, the routine proceeds to block 611*b* and stops rotation of the coin disk 222. Additionally, in some embodiments the coin disk 222 can be paused in the stopped position for a preset period of time. After stopping (and/or pausing), the routine proceeds to block 614*b* and resets the time to $T_0$. Then, in block 616*b*, the coin disk 222 starts rotating in the opposite direction. From block 616*b*, the routine returns to decision block 607*b* to determine if the counter rotation of the coin disk has alleviated the jam. If not, the routine proceeds again to block 611*b* and repeats as described above to alleviate the jam.

If a jam is not detected at decision block 607*b*, the routine proceeds to decision block 608*b* to determine if the coin disk 222 has been rotating in one direction for an elapsed time equal to T. In some embodiments, the elapsed time T can be equal to a period of time between 0.5 second and 3 seconds, such as about 2 seconds. In other embodiments, the coin disk 222 can be configured to rotate in one direction for other periods of time. If the coin disk has not been rotating in the particular direction for a period of time equal to T, then the routine returns to decision block 607*b* and proceeds as described above. Once the coin disk has rotated in the direction for the preset period of time T, the routine proceeds to block 610*b* and stops (and/or pauses) the coin disk 222. After stopping, the routine proceeds to decision block 612*b* to determine if all the coins that were deposited in the coin input tray 110 have been transferred out of the coin input tray 110 through the coin outlet opening 254. If not, the routine returns to block 614*b* and resets the time to $T_0$. From block 614*b*, the routine proceeds to block 616*b* and begins rotating the coin disk in the opposite direction as described above. Once all of the coins have been transferred out of the coin input tray 110, the routine ends.

Turning next to FIG. 6C, the routine 600*c* describes yet another process for operating the coin input tray 110 and associated systems in accordance with an embodiment of the present technology. As with the routines 600*a* and 600*b* described above, the routine 600*c* begins when coins are dumped or otherwise placed into the coin input tray 110 and a start signal is received (block 602*c*). In block 604*c*, the routine sets the time equal to $T_0$. The routine then opens the coin gate 224 in block 605*c*, and starts rotating the coin disk 222 in a first direction in block 606*c*. As the coin disk 222 rotates, it transfers coins placed thereon out of the coin input tray 110 through the coin outlet opening 254 and past the open coin gate 224. In decision block 608*c*, the routine determines if an amount of time equal to T has elapsed. If not, the routine continues to rotate the coin disk 222 until a period of time equal to T has elapsed. Once a time period equal to T has elapsed, the routine proceeds to block 610*c* to pause the coin disk for a preset period of time equal to P. In some embodiments, the period of time P can be equal to a period of time between zero seconds and 3 seconds, such as about 1 second. In other embodiments, the coin disk 222 can be paused for other periods of time P. After the coin disk has paused for a period of time equal to P, the routine proceeds to decision block 611*c* to determine if the coin disk should be paused for a longer period of time. For example, in some embodiments the routine can determine (via, e.g. a sensor operably positioned relative to the coin cleaner 230) if the coin cleaner 230 is currently operating at full capacity (e.g., the coin cleaner 230 cannot receive any more coins until it has processed at least a portion of the coins it currently contains), and/or if the coin processing apparatus 120 is operating capacity. If either the coin cleaner 230 or the coin processing apparatus 120 is currently operating at capacity and should not receive additional coins at the moment, the routine returns to block 610*c* to extend the period of pausing the coin disk 222. Alternatively, if both the coin cleaner 230 and the coin processing apparatus 120 can continue to receive additional coins, the routine proceeds to decision block 612*c* to determine if all of the coins have been transferred out of the tray. If not, the routine proceeds to block 614*c* and resets the timer to $T_0$. The routine then proceeds to block 616*c* and starts rotating the coin disk 222 in the opposite direction, and from there the routine returns to decision block 608*c* and proceeds as described above. Returning to decision block 612*c*, once all the coins have been transferred out of the coin input tray 110, the routine proceeds to 618*c* and closes the coin gate 224, after which the routine ends.

Aspects of the operational routines described herein can be embodied in computer-executable instructions, such as routines executed by the controller 502 or other data processing device associated with the kiosk 100. Those of ordinary skill in the art can create source code, microcode, program logic arrays or otherwise implement technology based on the routines 600*a*-600*c* and the detailed description provided herein. All or a portion of the routines 600*a-c* can be stored in memory (e.g., nonvolatile memory) that forms a portion of the controller 502 (FIG. 5) or can be stored in removable media, such as discs, or hardwired or preprogrammed in chips such as EEPROM semiconductor chips. The functions and steps can be implemented by an application specific integrated circuit (ASIC), a digital signal processing (DSP) integrated circuit, per conventional programmed logic arrays or circuit elements. While many or some of the embodiments may be shown and described as being implemented in hardware (e.g., one or more integrated circuits designed specifically for a task or operation), such embodiments could equally be implemented in software and be performed by one or more processors. Such software can be stored on any suitable computer-readable medium, such as microcode stored in a semiconductor chip, on a computer-readable disc, or downloaded from a server and stored locally at a client. Accordingly, although specific circuitry may be described herein, those of ordinary skill in the art will recognize that a microprocessor-based system could also be used for any logical decisions that are configured in software.

Aspects of the routines described herein can be embodied in a special purpose computer or data processor (e.g., the controller 502) that is specifically programmed, configured, or constructed to perform one or more of the computer-executable instructions explained in detail herein. While aspects of the invention, such as certain functions, are described as being performed exclusively on a single device, the invention can also be practiced in distributed environments where functions or modules are shared among disparate processing devices, which are linked through a communications network, such as a Local Area Network (LAN), Wide Area Network (WAN), or the Internet. In a distributed computing environment, program modules may be located in both local and remote memory storage devices.

Aspects of the invention may be stored or distributed on tangible computer-readable media, including magnetically or optically readable computer discs, hard-wired or preprogrammed chips (e.g., EEPROM semiconductor chips), nanotechnology memory, biological memory, or other data storage media. Alternatively, computer implemented instructions, data structures, screen displays, and other data under aspects of the invention may be distributed over the Internet or over other networks (including wireless networks), on a propagated signal on a propagation medium (e.g., an electromagnetic wave(s), a sound wave, etc.) over a period of time, or they may be provided on any analog or digital network (packet switched, circuit switched, or other scheme).

In general, display descriptions may be in HTML, XML or WAP format, email format or any other format suitable for displaying information (including character/code-based formats, algorithm-based formats (e.g., vector generated), and bitmapped formats). Also, various communication channels, such as local area networks, wide area networks, or point-to-point dial-up connections, may be used instead of the Internet. The system may be conducted within a single computer environment, rather than a client/server environment. Also, the user computers may comprise any combination of hardware or software that interacts with the server computer, such as television-based systems and various other consumer products through which commercial or noncommercial transactions can be conducted. The various aspects of the invention described herein can be implemented in or for any e-mail environment.

The described features, advantages, and characteristics of the present technology may be combined in any suitable manner in one or more embodiments. One skilled in the relevant art will recognize that the present technology can be practiced without one or more of the specific features or advantages of a particular embodiment. In other instances, additional features and advantages may be recognized in certain embodiments that may not be present in all embodiments of the present technology.

Any patents and applications and other references noted above, including any that may be listed in accompanying filing papers, are incorporated herein by reference in their entireties. Aspects of the invention can be modified, if necessary, to employ the systems, functions, and concepts of the various references described above to provide yet further implementations of the invention.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples and embodiments of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements. Further any specific numbers noted herein are only examples: alternative implementations may employ differing values or ranges.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

Although certain aspects of the invention are presented below in certain claim forms, the applicant contemplates the various aspects of the invention in any number of claim forms. Accordingly, the applicant reserves the right to pursue additional claims after filing this application to pursue such additional claim forms, in either this application or in a continuing application.

I claim:

1. An automatic coin input apparatus for use with a coin counting and/or sorting machine, the automatic coin input apparatus comprising:

a rotatable disk configured to support a plurality of randomly oriented coins deposited thereon;

a coin outlet opening positioned proximate the rotatable disk;

a coin deflector disposed adjacent to the coin outlet opening;

a first coin passage positioned proximate the rotatable disk, wherein the first coin passage extends through the coin outlet opening adjacent to a first side of the deflector; and a second coin passage positioned proximate the rotatable disk, wherein the second coin passage extends through the coin outlet opening adjacent to a second side of the deflector opposite the first side, wherein rotation of the rotatable disk in a first direction automatically drives coins deposited thereon outwardly through the first coin passage in a non-singulated manner, and wherein rotation of the rotatable disk in a second direction opposite to the first direction automatically drives coins deposited thereon outwardly through the second coin passage in a non-singulated manner.

2. The automatic coin input apparatus of claim 1 wherein the coin deflector is vertically disposed at least approximately in the middle of the coin outlet opening.

3. The automatic coin input apparatus of claim 1, further comprising a sidewall extending around at least a portion of the rotatable disk proximate an outer edge portion thereof, wherein the coin outlet opening is formed in the sidewall.

4. The automatic coin input apparatus of claim 1, further comprising a sidewall extending around at least a portion of the rotatable disk proximate an outer edge portion thereof, wherein the coin outlet opening is formed in the sidewall, and wherein the coin deflector extends vertically across the opening.

5. The automatic coin input apparatus of claim 1, further comprising a sidewall extending around at least a portion of the rotatable disk proximate an outer edge portion thereof, wherein the coin outlet opening is formed in the sidewall, and wherein the coin deflector is a cylindrical member that extends vertically across the opening.

6. The automatic coin input apparatus of claim 1, further comprising:

a motor operably coupled to the rotatable disk;

a sensor operably positioned proximate the coin outlet opening; and a controller operably connected to the motor and the sensor, wherein the sensor is configured to send a signal to the controller in response to detecting a coin jam proximate the coin outlet opening, and wherein the controller is configured to reverse the motor and rotate the disk in the opposite direction in response to the signal.

7. The automatic coin input apparatus of claim 1, further comprising:

a sidewall extending around at least a portion of the rotatable disk proximate an outer edge portion thereof; and a support surface fixedly disposed proximate the sidewall, wherein the support surface slidably supports the outer edge portion of the rotatable disk during rotation of the rotatable disk.

8. The automatic coin input apparatus of claim 1, wherein rotation of the rotatable disk in the first direction automatically drives coins deposited thereon outwardly through the first coin passage but not the second coin passage, and wherein rotation of the rotatable disk in the second direction automatically drives coins deposited thereon outwardly through the second coin passage but not the first coin passage.

9. The automatic coin input apparatus of claim 1, further comprising:

a motor operably coupled to the rotatable disk; and a controller operably connected to the motor, wherein the motor is configured to automatically rotate the disk in the first direction, stop or pause, and then rotate the disk in the second direction in response to signals from the controller.

10. The automatic coin input apparatus of claim 1, further comprising:

a motor operably coupled to the rotatable disk;

a sensor operably positioned relative to the coin counting and/or sorting machine; and a controller operably connected to the motor and the sensor, wherein the sensor is configured to send a signal to the controller in response to detecting a jam associated with the coin counting and/or sorting machine, and wherein the controller is configured to stop the motor from rotating the disk in response to the signal.

11. The automatic coin input apparatus of claim 1, further comprising:

a motor operably coupled to the rotatable disk;

a sensor operably positioned relative to the coin counting and/or sorting machine; and a controller operably connected to the motor and the sensor, wherein the sensor is configured to send a signal to the controller in response to detecting that at least a portion of the coin counting and/or sorting machine is operating at full capacity, and wherein the controller is configured to stop the motor from rotating the disk in response to the signal.

12. The automatic coin input apparatus of claim 1, further comprising a movable gate operably positionable to selectively block the passage of coins through the first and second coin passages.

13. An automatic coin input apparatus for use with a coin counting and/or sorting machine, the automatic coin input apparatus comprising:

a rotatable disk configured to support a plurality of randomly oriented coins deposited thereon;

a coin outlet opening positioned proximate the rotatable disk;

a coin deflector disposed adjacent to the coin outlet opening;

a first coin passage positioned proximate the rotatable disk, wherein the first coin passage extends through the coin outlet opening adjacent to a first side of the deflector;

a second coin passage positioned proximate the rotatable disk, wherein the second coin passage extends through the coin outlet opening adjacent to a second side of the deflector opposite the first side, wherein rotation of the rotatable disk in a first direction automatically drives coins deposited thereon outwardly through the first coin passage, and wherein rotation of the rotatable disk in a second direction opposite to the first direction automatically drives coins deposited thereon outwardly through the second coin passage; and a movable gate operably positionable across at least a portion of the coin outlet opening to selectively block the passage of coins through the opening, wherein the coin deflector is positioned between the movable gate and the rotatable disk.

14. An automatic coin input apparatus for use with a coin counting and/or sorting machine, the automatic coin input apparatus comprising:

a rotatable disk configured to support a plurality of randomly oriented coins deposited thereon;

a coin outlet opening positioned proximate the rotatable disk;

a coin deflector disposed adjacent to the coin outlet opening;

a first coin passage positioned proximate the rotatable disk, wherein the first coin passage extends through the coin outlet opening adjacent to a first side of the deflector;

a second coin passage positioned proximate the rotatable disk, wherein the second coin passage extends through the coin outlet opening adjacent to a second side of the deflector opposite the first side, wherein rotation of the rotatable disk in a first direction automatically drives coins deposited thereon outwardly through the first coin passage, and wherein rotation of the rotatable disk in a second direction opposite to the first direction automatically drives coins deposited thereon outwardly through the second coin passage; and a header member having a first surface portion and a second surface portion extending across an upper portion of the coin outlet opening, wherein the first surface portion faces the rotatable disk and the second surface portion faces the rotatable disk, and wherein the second surface portion is positioned below the first surface portion and offset outwardly therefrom to define a step therebetween.

15. The automatic coin input apparatus of claim 14 wherein the first and second surface portions are generally cylindrical surface portions.

16. A coin input tray for use with a consumer-operated kiosk, the coin input tray comprising:

a rotatable disk configured to rotate in a fixed plane and support a plurality of randomly oriented coins deposited thereon;

a sidewall extending upwardly around at least a portion of the rotatable disk to at least partially define a coin bowl;

a support surface fixedly disposed proximate a lower portion of the sidewall, wherein the rotatable disk is configured to slidably contact the support surface during rotation thereof;

a coin outlet opening disposed proximate the rotatable disk and adjacent the sidewall; and a coin deflector disposed adjacent to the coin outlet opening, wherein a first coin passage extends between the coin deflector and a left boundary of the coin outlet opening, and wherein a second coin passage extends between the coin deflector and a right boundary of the coin outlet opening, wherein rotation of the rotatable disk in a first direction automatically drives a first portion of the coins from the coin bowl and into the coin outlet opening through the first coin passage in a non-singulated manner, and wherein rotation of the rotatable disk in a second direction opposite to the first direction drives a second portion of the coins from the coin bowl and into the coin outlet opening through the second coin passage in a non-singulated manner.

17. The coin input tray of claim 16 wherein the support surface is annular in shape.

18. The coin input tray of claim 16, further comprising:

a movable gate positioned proximate the coin outlet opening;

means for selectively moving the movable gate between a first position closing off the coin outlet opening and a second position spaced apart from the opening; and means for rotating the rotatable disk in the first direction and the second direction.

19. The coin input tray of claim 16 wherein the first and second coin passages are formed in the sidewall.

20. The coin input tray of claim 16, further comprising:

a motor operably coupled to the rotatable disk; and a controller operably connected to the motor, wherein the motor is configured to automatically rotate the disk in the first direction, stop or pause, and then rotate the disk in the second direction in response to signals from the controller.

21. The coin input tray of claim 16, further comprising:

a motor operably coupled to the rotatable disk;

a sensor operably positioned proximate at least one of the first and second coin passages; and a controller operably connected to the motor and the sensor, wherein the sensor is configured to send a signal to the controller in response to detecting a coin jam proximate the at least one coin passage, and wherein the controller is configured to reverse the motor and rotate the disk in the opposite direction in response to the signal.

* * * * *

UNITED STATES PATENT AND TRADEMARK OFFICE

CERTIFICATE OF CORRECTION

PATENT NO. : 9,235,945 B2
APPLICATION NO. : 14/177213
DATED : January 12, 2016
INVENTOR(S) : Douglas A. Martin It is certified that error appears in the above-identified patent and that said Letters Patent is hereby corrected as shown below:

Specification

In column 11, line 67, delete “Igus®” and insert -- igus® --, therefor.

Signed and Sealed this
Twenty-sixth Day of April, 2016

Michelle K. Lee

Michelle K. Lee
*Director of the United States Patent and Trademark Office*